US011878219B2

(12) United States Patent
Muroda et al.

(10) Patent No.: US 11,878,219 B2
(45) Date of Patent: Jan. 23, 2024

(54) VERTICAL JUMP SYSTEM

(71) Applicant: Murodas, Inc., Honolulu, HI (US)

(72) Inventors: Grant Shigeo Muroda, Honolulu, HI (US); John Douglas Kilpatrick, III, Honolulu, HI (US)

(73) Assignee: Murodas, Inc., Honolulu, HI (US)

( * ) Notice: Subject to any disclaimer, the term of this patent is extended or adjusted under 35 U.S.C. 154(b) by 183 days.

(21) Appl. No.: 17/495,455

(22) Filed: Oct. 6, 2021

(65) Prior Publication Data

US 2022/0105376 A1 Apr. 7, 2022

Related U.S. Application Data

(60) Provisional application No. 63/088,175, filed on Oct. 6, 2020.

(51) Int. Cl.
*A63B 5/04* (2006.01)
*A63B 6/02* (2006.01)

(52) U.S. Cl.
CPC ..... *A63B 5/04* (2013.01); *A63B 6/02* (2013.01); *A63B 2225/093* (2013.01); *A63B 2244/081* (2013.01)

(58) Field of Classification Search
CPC ..... A63B 5/04; A63B 6/02; A63B 2225/093; A63B 2244/081; A63B 2071/0063; A63B 2210/50; A63B 71/023; A63B 71/04; A63B 2209/00
See application file for complete search history.

(56) References Cited

U.S. PATENT DOCUMENTS 924,075 A * 6/1909 Johnson ..... A61G 13/12 5/621
2,119,808 A * 6/1938 Fecht ..... A63K 3/043 482/16
2,583,786 A * 1/1952 Marzucco ..... A63K 3/043 16/199
2,706,631 A * 4/1955 Holmes ..... A63K 3/043 482/17
2,884,252 A * 4/1959 Thompson ..... A63B 63/008 482/17
3,394,932 A * 7/1968 Leflar ..... A63K 3/043 482/17
3,497,212 A * 2/1970 Gotcher ..... A63B 5/02 482/17
3,850,401 A * 11/1974 Snediker ..... F16B 7/0486 40/604

(Continued)

*Primary Examiner* — Garrett K Atkinson
(74) *Attorney, Agent, or Firm* — Offit Kurman, P.A.; Joseph P. Mathew

(57) ABSTRACT

A vertical jump system is described herein. The system includes a first member and a second member each having a member base that sits under a flooring, a flexible cord that extends between the first member and the second member at a desired height, fixtures coupled to the flexible cord along the first member and the second member. The flexible cord remains at the desired height when contacted. The fixtures are slidable along the first member and the second member and adjust the height of the flexible cord. This configuration allows a user to easily adjust the height of the vertical jump for training, athletics, and competition, without the cord or system components dislodging and causing injury to the user.

18 Claims, 26 Drawing Sheets

(56) References Cited

U.S. PATENT DOCUMENTS 4,227,688 A * 10/1980 Senoh ..... A63B 1/00 403/205
4,415,163 A * 11/1983 Schoenig ..... A63B 61/02 473/492
4,749,187 A * 6/1988 Dellinger ..... A63K 3/043 482/17
4,946,139 A * 8/1990 Tomellini ..... A63K 3/046 256/64
5,215,310 A * 6/1993 Allbright ..... A63B 61/02 473/493
5,334,119 A * 8/1994 Eloranta ..... A63K 3/046 482/16
5,358,257 A * 10/1994 Pardi ..... A63B 61/02 473/493
5,611,539 A * 3/1997 Watterson ..... A63B 69/0084 273/400
5,755,631 A * 5/1998 Paschka ..... A63B 69/0095 473/424
5,807,195 A * 9/1998 Westbrook ..... A63B 63/083 473/447
5,951,417 A * 9/1999 Ha ..... A63B 61/02 473/493
5,957,781 A * 9/1999 Kelly ..... A63B 69/0084 473/142
5,967,093 A * 10/1999 Vitt ..... A63K 3/046 482/16
6,461,258 B1 * 10/2002 Vacanti ..... A63B 61/003 473/494
7,410,431 B2 * 8/2008 Underwood ..... A63B 61/02 473/492
7,438,668 B1 * 10/2008 Watry ..... A63K 3/043 482/17
8,016,728 B2 * 9/2011 Derry ..... A63K 3/04 482/17
D783,742 S * 4/2017 Adema ..... D21/699
10,000,904 B2 * 6/2018 Hurley ..... E04G 21/00
2001/0002377 A1 * 5/2001 Schroeder ..... A63B 61/02 473/473
2007/0082794 A1 * 4/2007 Sams, III ..... A63B 69/0002 482/92
2009/0275444 A1 * 11/2009 Derry ..... A63B 5/04 482/17
2011/0136594 A1 * 6/2011 Orr ..... A63B 71/06 473/426
2014/0135153 A1 * 5/2014 Wartenweiler ..... A63B 71/023 473/478
2014/0150174 A1 * 6/2014 Erickson ..... A47K 3/001 4/580
2014/0243119 A1 * 8/2014 Whalen ..... A63B 61/02 473/493

* cited by examiner

VERTICAL JUMP SYSTEM

CROSS-REFERENCE TO RELATED APPLICATIONS

This application claims benefit under 35 U.S.C. § 119(e) of U.S. Provisional Application No. 63/088,175 filed on Oct. 6, 2020, the entire contents of which is incorporated herein by reference.

TECHNICAL FIELD

The present disclosure relates to a system for vertical jump training and athletics.

BACKGROUND

Vertical jump exercise and training systems are typically used in athletics to present an obstacle over which a user or athlete must jump. Traditional vertical jumping training apparatuses include heavy vertical standards on bases and which are weighted to provide the apparatus with needed stability. Further, many of these devices are constructed from heavy materials, such as steel, which may make moving or storage of these apparatuses difficult.

Traditional vertical jumping apparatuses present a substantial risk of injury to athletes during use. Vertical jump assemblies that utilize horizontal crossbars of aluminum or fiberglass material as the "obstacle" have difficulty adjusting the height of the crossbar, and the bar can easily dislodge if a user merely taps the bar when attempting to jump over it. Thus, the detached bar may fall onto a jumper or the jumper may land on the bar causing injury or bruising. In addition, time must be spent resetting the rigid bar back onto the apparatus each time the bar is displaced. Further, vector forces may be created during an attempted jump, which may cause other components of the vertical jump apparatus to collapse or fall, again risking harm to the user.

SUMMARY

There is a need for a lightweight and sturdy vertical jump system that includes an adjustable and flexible crossbar that remains at the desired height when contacted by a user. An embodiment of the present disclosure is a vertical jump system. The vertical jump system includes a first member that extends in a longitudinal direction from a flooring. The first member includes a first member base configured to slidably couple the first member to the flooring. The vertical jump system further includes a second member spaced from the first member that extends from the flooring in a longitudinal direction and parallel to the first member. The second member includes a second member base configured to slidably couple the second member to the flooring. The vertical jump system further includes a flexible cord that extends between the first member and the second member at a desired height. The flexible cord is configured to remain at the desired height when contacted. The vertical jump system further includes a first fixture positioned on the first member and configured to couple the first member with the flexible cord and slidably adjust the height of the flexible cord along the first member. The vertical jump system further includes a second fixture positioned on the second member and configured to couple the second member with the flexible cord and slidably adjust the height of the flexible cord along the second member.

Another embodiment of the present disclosure is a vertical jump system. The vertical jump system includes a first member that extends in a longitudinal direction from a landing pad. The first member includes a first member base configured to slidably couple the first member to the landing pad. The vertical jump system further includes a second member spaced from the first member that extends from the landing pad in a longitudinal direction and parallel to the first member. The second member includes a second member base configured to slidably couple the second member to the landing pad. The vertical jump system further includes a flexible cord that extends between the first member and the second member at a desired height. The flexible cord is configured to remain at the desired height when contacted. The vertical jump system further includes a first fixture positioned on the first member and configured to hold the flexible cord in two-way tension at the desired height and slidably adjust the height of the flexible cord along the first member. The vertical jump system further includes a second fixture positioned on the second member and configured to hold the flexible cord in two-way tension at the desired height and slidably adjust the height of the flexible cord along the second member.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

and

Figure 17:
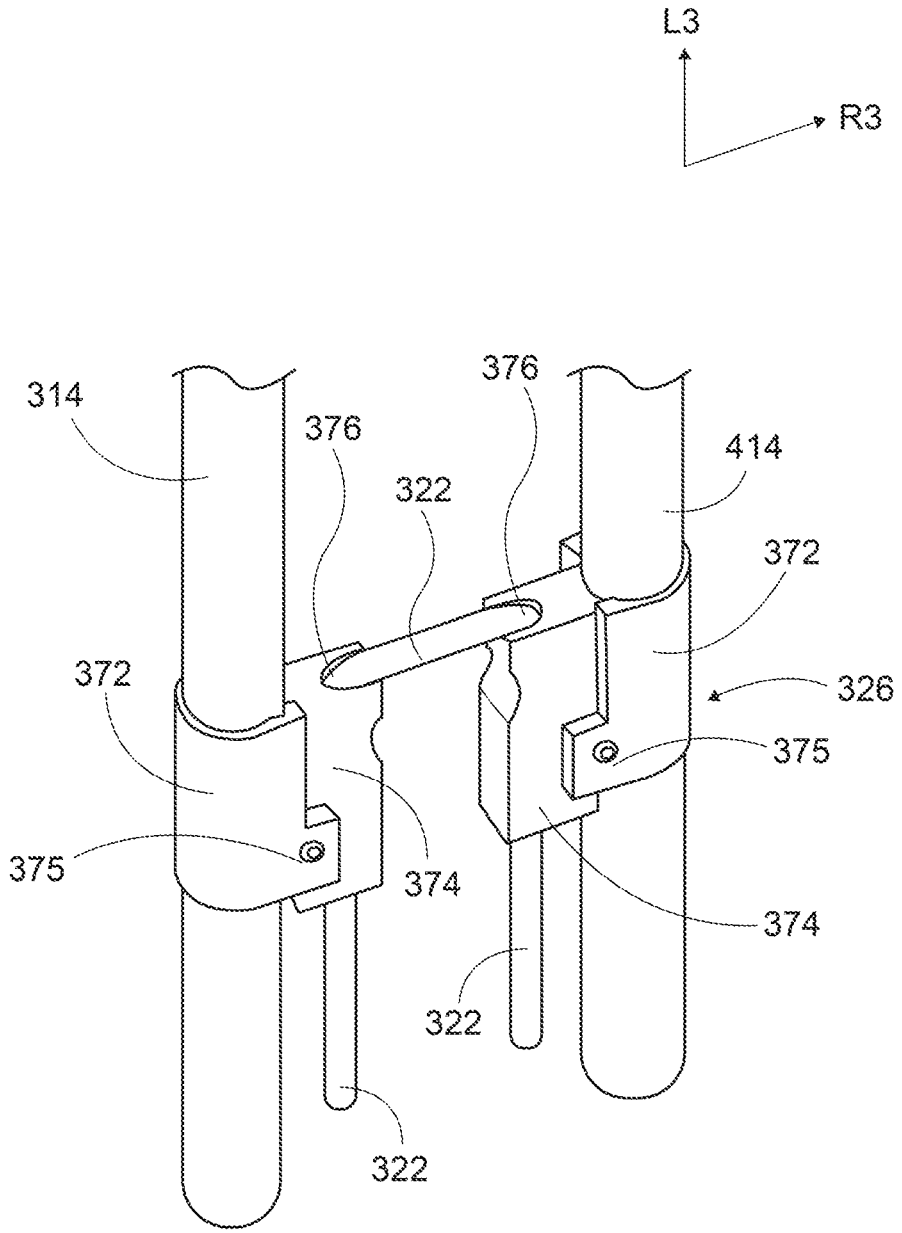
FIG. 17 is a diagram showing the flexible cord through the fixtures shown in FIG. 14.
Figure 18:
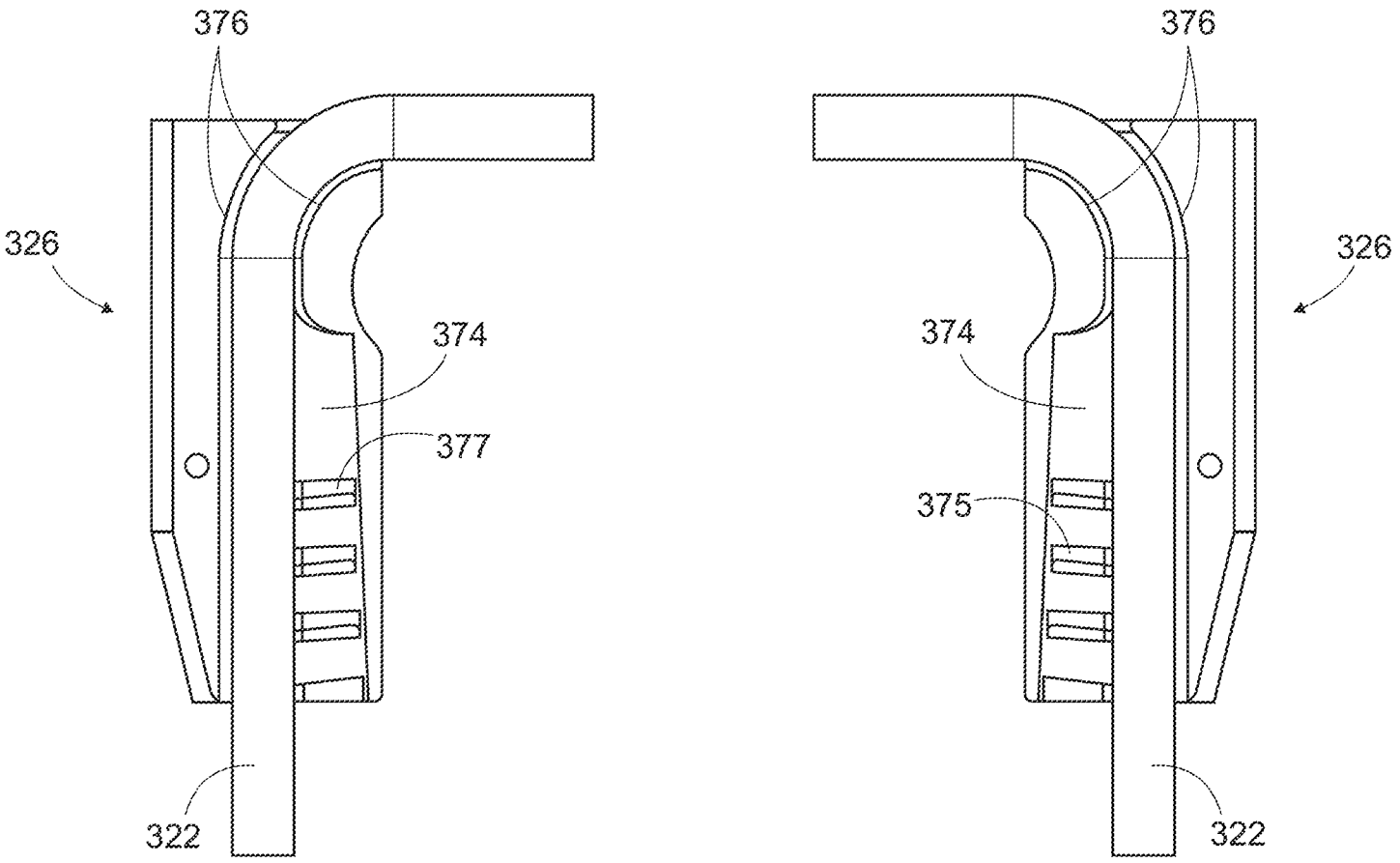

FIG. 18 is a front cross-sectional view of the flexible cord through the block of the fixtures shown in FIG. 17.

DETAILED DESCRIPTION OF ILLUSTRATIVE EMBODIMENTS

Figure 1:
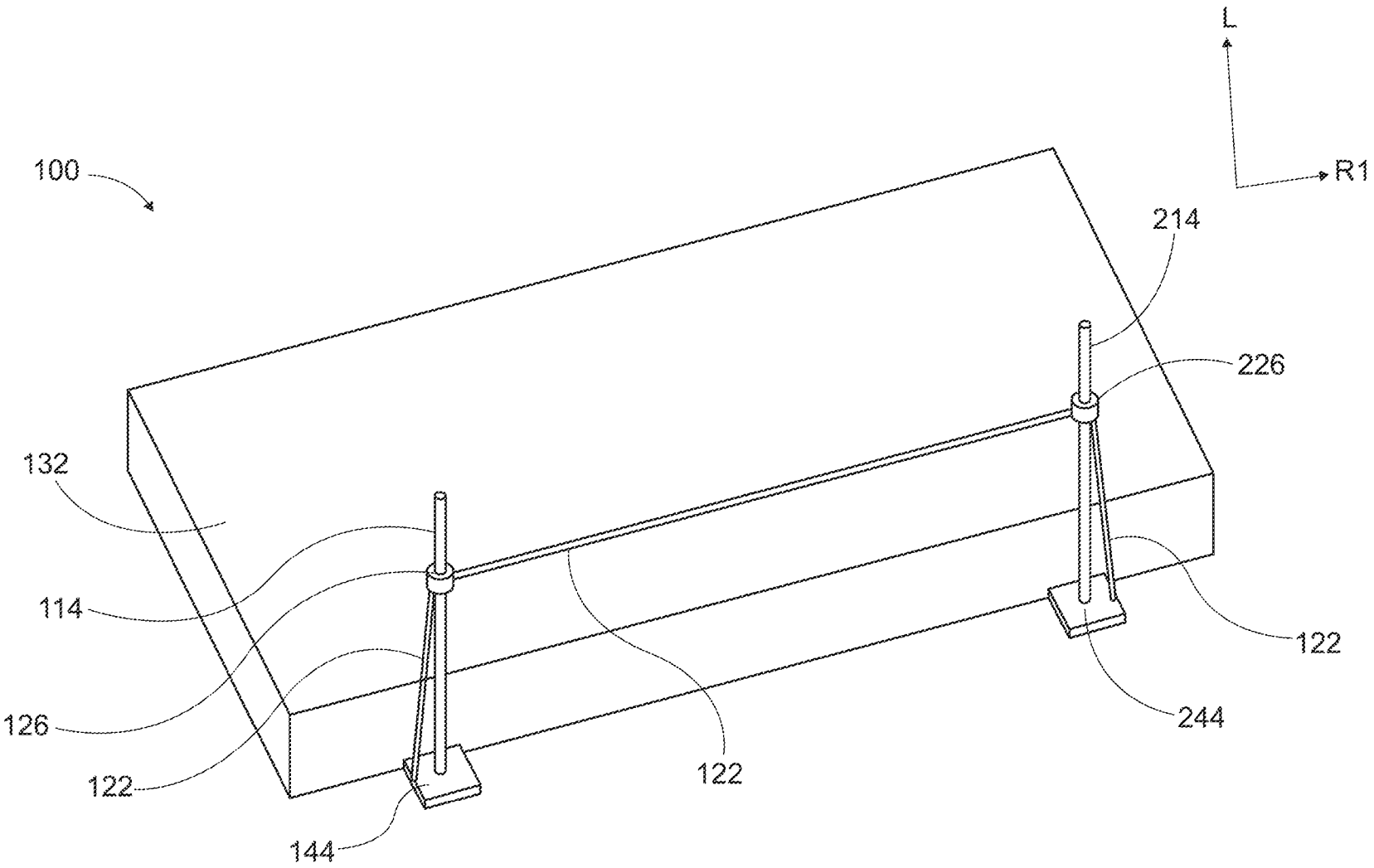
FIG. 1 is a perspective view of a vertical jump system, according to an embodiment of the present disclosure.

Embodiments of the present disclosure include a vertical jump system 100. The vertical jump system 100 includes a first member 114, a second member 214 spaced from the first member 114, a first fixture 126 located on the first member 114, and a second fixture 226 located on the second member 214. The vertical jump system further includes a flexible cord 122 coupled to the first fixture 126 and the second fixture 226 at a desired height along the first member 114 and the second member 214 (FIG. 1). The flexible cord 122 acts as the "obstacle" for a user to jump over, and remains at a desired height when a user inadvertently contacts or actuates the flexible cord 122.

The vertical jump system 100 may be used for vertical jump training, athletics, and competition. The vertical jump system 100 may also be utilized indoors or outdoors, and in conjunction with various flooring 132. Thus, in one example, the flooring 132 may be a landing pit. In another example, the flooring 132 may be a landing pad. In yet another example, other types of flooring known in the art may be utilized. As a result, the vertical jump system 100 is not limited in use to a specific site or area, and may instead be used in numerous locations. The vertical jump system 100 may also be lightweight and portable. This configuration reduces the risk of injury to a user during training or competition, while also efficiently preventing the system from collapsing or dislodging.

Figure 2A:
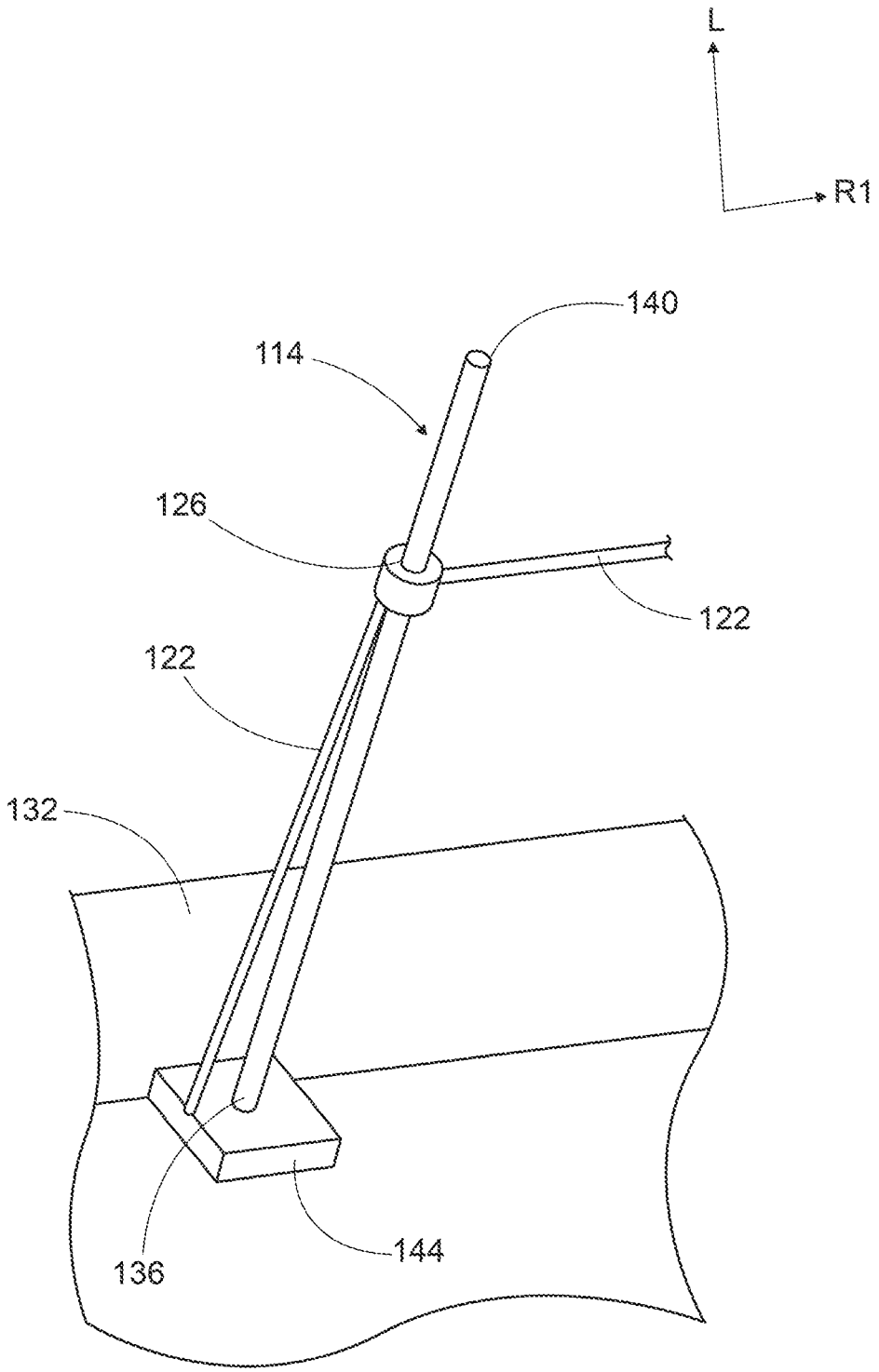
FIG. 2A is a detailed view of the first member shown in FIG. 1.

Referring to FIGS. 1-2A, the first member 114 includes a distal end 136 and a proximal end 140 that extends from the distal end 136 in a longitudinal direction L. The distal end 136 of the first member 114 includes a member base 144 configured to couple the first member 114 to the flooring 132. In the illustrated embodiment, the first member 114 is cylindrical in shape. In alternative embodiments, the shape of the first member 114 may vary. The first member 114 may be made of materials including, but not limited to galvanized steel or PVC pipe. In one embodiment, the first member 114 may be made from commercially available material for wire shelf assemblies. In addition, in the illustrated embodiment, the length of the first member 114 may range from about 3 feet to about 8 feet, and may be extendable. In another embodiment, the length of the first member 114 may be greater than 8 feet.

Figure 2B:
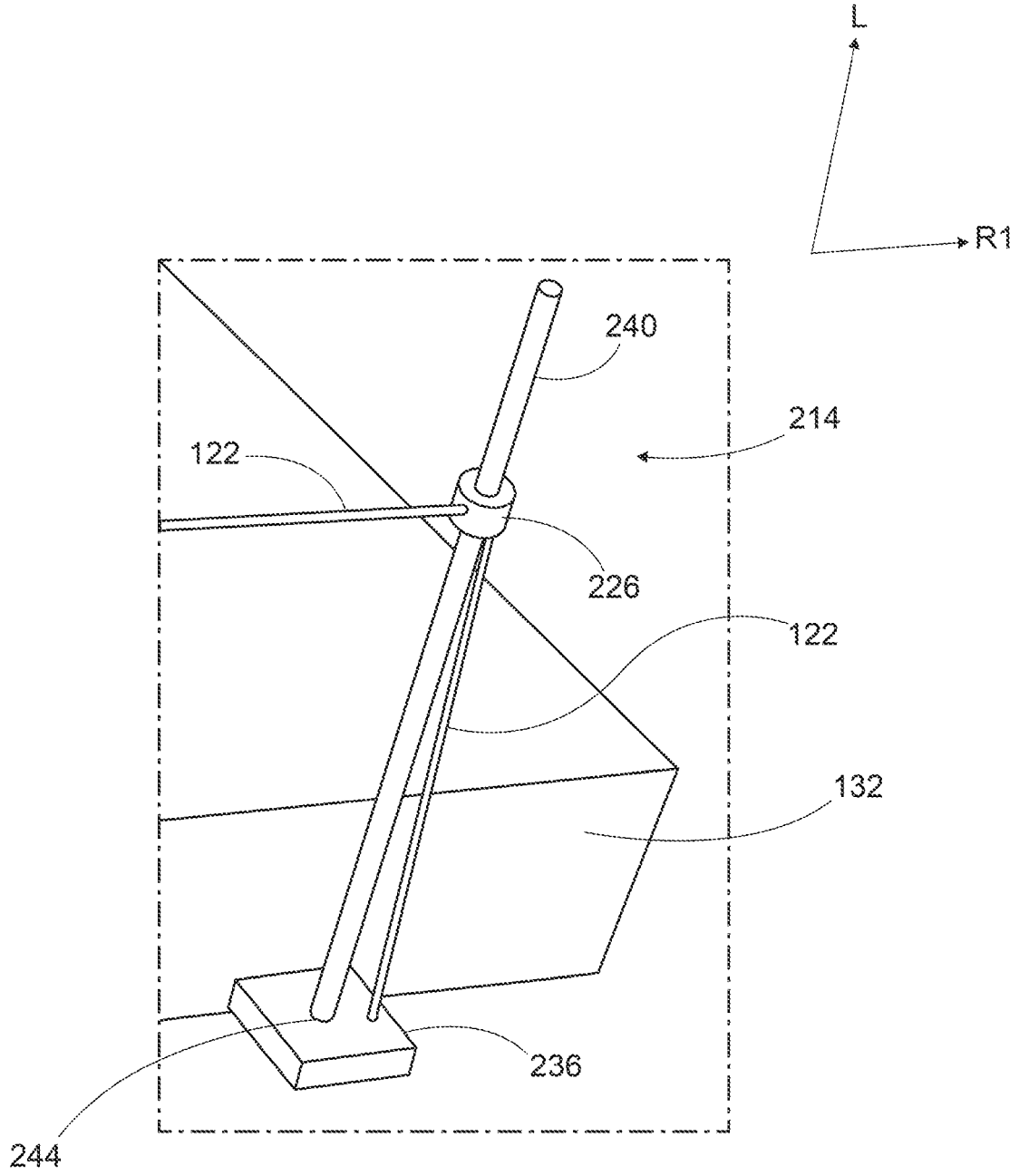
FIG. 2B is a detailed view of the second member shown in FIG. 1.

As shown in FIG. 2B, the second member 214 is spaced from the first member 114 in a first radial direction R1. The second member 214 similarly includes a distal end 236 and a proximal end 240 that extends from the distal end 236 in a longitudinal direction L. The distal end 236 of the second member 214 further includes a member base 244 configured to couple the second member 214 to the flooring 132. In the illustrated embodiment, the second member 214 is cylindrical in shape. In alternative embodiments, the shape of the second member 214 may vary. The second member 214 may be made of materials including, but not limited to galvanized steel or PVC pipe. In one embodiment, the second member 214 may be made from commercially available material for wire shelf assemblies. In addition, the length of the second member 214 may range from about 3 feet to about 8 feet, and may be extendable. In another embodiment, the length of the second member 214 may be greater than 8 feet.

The first member 114 and the second member 214 are configured to stabilize and couple the various components of the vertical jump system 100. Specifically, the first member 114 and the second member 214 stabilize the flexible cord 122 and allow the flexible cord 122 to be slidably adjusted along the first member 114 and the second member 214 via the first fixture 126 and the second fixture 226. The first member 114 and the second member 214 may display numbers in 1" increments from the distal end 136 to the proximal end 140. The first member 114 and the second member 214 may be epoxy-coated for UV and rust resistance.

Figure 3:
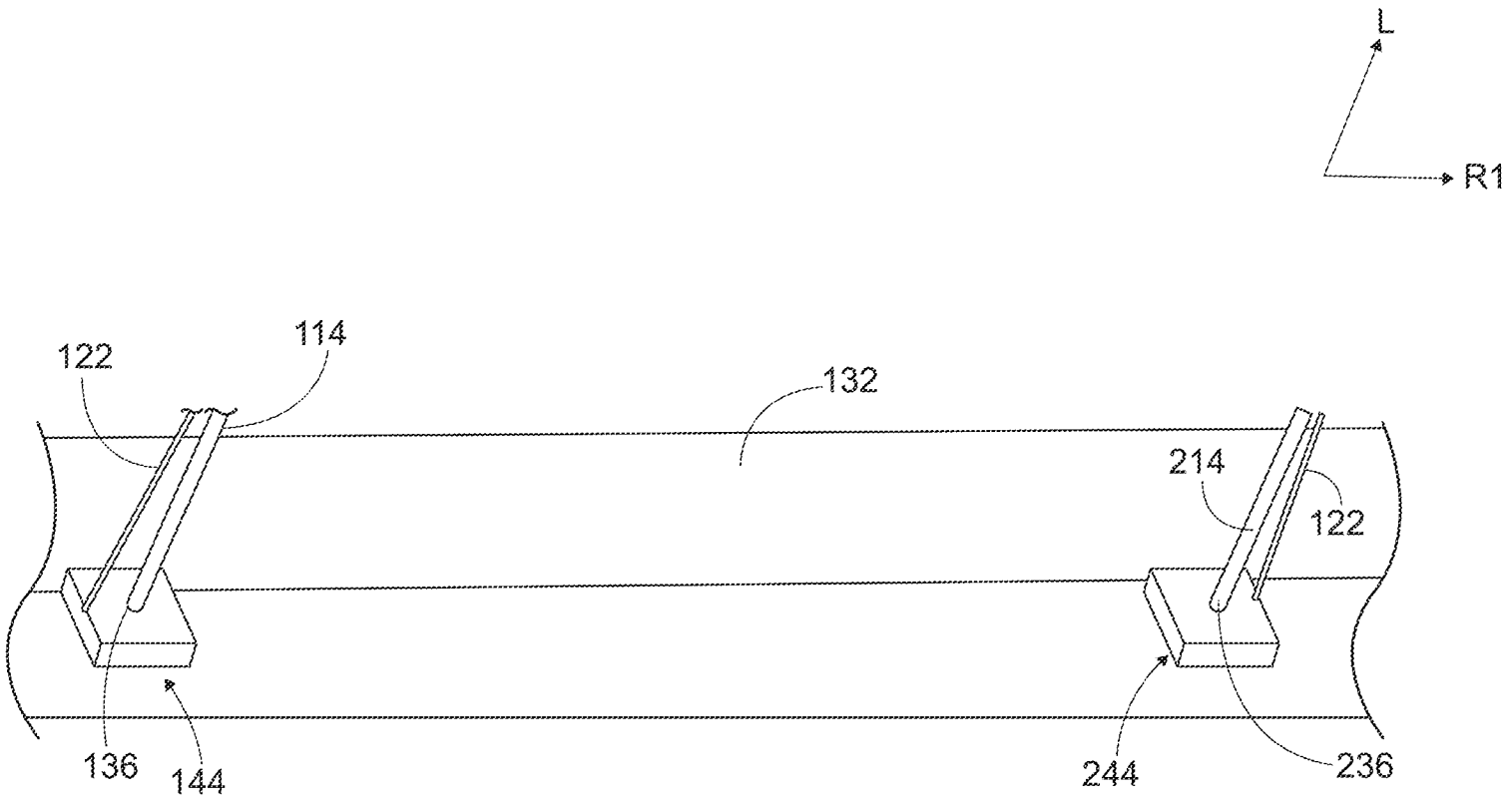
FIG. 3 is a detailed view of the first member base and the second member base shown in FIG. 1.
Figure 4A:
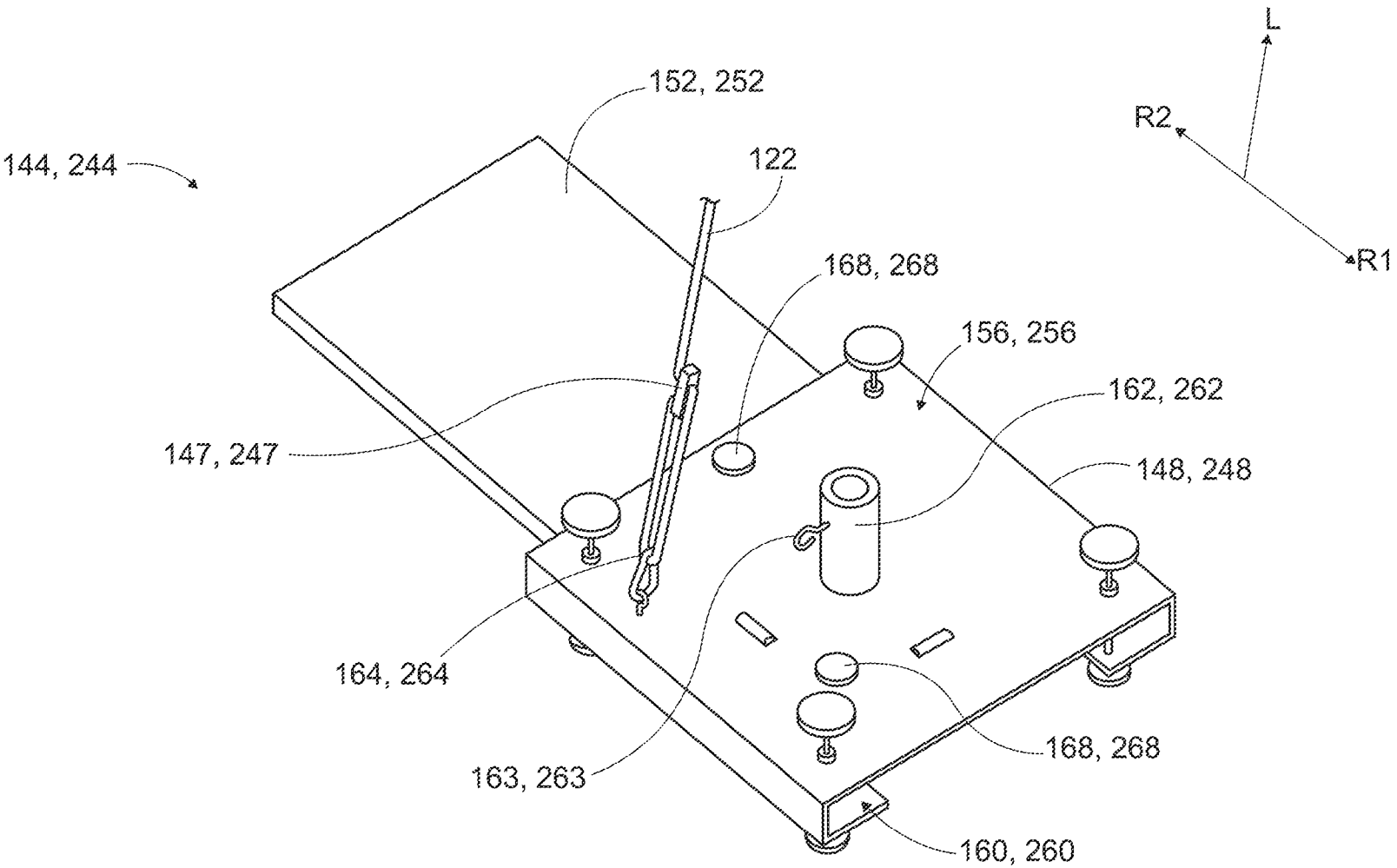
FIG. 4A is a perspective view of an exemplary member base shown in FIGS. 1-2B.
Figure 4B:
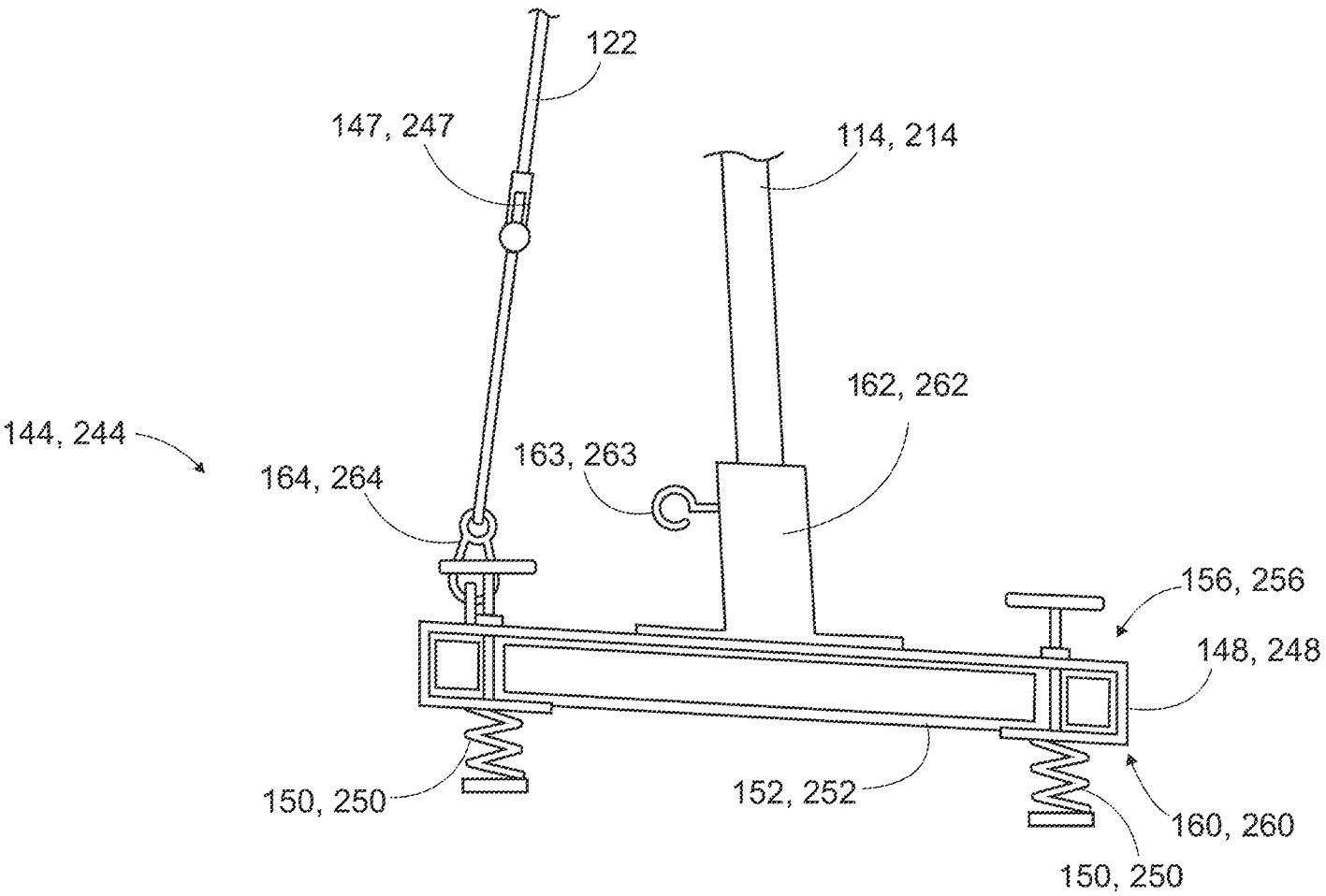
FIG. 4B is a drawing showing a front view of the member base shown in FIG. 3.

Referring to FIGS. 3-4B, each of the first member 114 and the second member 214 include a member base 144, 244. The first member 114 includes a first member base 144. The first member base 144 is configured to slidably couple the first member 114 to the flooring 132. The second member 114 includes a second member base 244. The second member base 244 is configured to slidably couple the second member 214 to the flooring 132. It should be noted that the structure and components of the first member base 144 and the second member base 244 are interchangeable. FIGS. 3-4B are therefore used to describe both the first member base 144 and the second member base 244.

As shown in FIGS. 4A-4B, the member base 144, 244 includes an outer housing base 148, 248 and a slidable insert 152, 252. The outer housing base 148, 248 includes a top portion 156, 256 and a bottom portion 160, 260. The top portion 156, 256 includes a vessel 162, 262, a support link 164, 264, and a plurality of connecting equipment 168, 268, each positioned on the surface of the top portion 156, 256. The vessel 162, 262 extends in the longitudinal direction L from the top portion 156, 256. The vessel 162, 262 is sized and shaped to fit the distal end 136, 236 of the first member 114, and the second member 214, respectively. In the illustrated embodiment, the vessel 162, 262 includes a screw 163, 263 that engages and holds the first member 114 and the second member 214 in place. In another embodiment, the first member 114 and the second member 214 may be held in the vessel 162, 262 by various known means.

The support link 164, 264 is configured to further couple the fixtures 126, 226 (FIGS. 1-2B) to the member base 144, 244. In one example, the support link 164, 264 may be a strap. In another example, the support link 164, 264 may be a clasp. In the illustrated embodiment, the support link 164, 264 may be connected to the flexible cord 122 to couple the fixtures 126, 226 to the member base 144, 244. This configuration may further stabilize the flexible cord 122 on the first member 114 and the second member 214. In addition, this configuration may allow the vertical jump system 100 to be easily converted from a system used in vertical jump training to a system used in vertical jump competition.

The plurality of connecting equipment 168, 268 aid in connecting the member base 144, 244 to the flooring 132 and in stabilizing the member base 144, 244. In one embodiment, the plurality of connecting equipment 168, 268 may be screws. In alternative embodiments, the plurality of connecting equipment 168, 268 may include side-mounted wedge constraints or other mechanical devices including springs, friction devices, clamps, and compression devices.

In the illustrated embodiment, the bottom portion 160, 260 may include a levelling mechanism 150, 250. In one embodiment, the levelling mechanism 150, 250 may include one or more shock-absorbing compression springs. In another embodiment, the levelling mechanism 150, 250 may include one or more compressible washers. The levelling mechanism 150, 250 may allow the top portion 156, 256 to be flat on the ground in all directions. It is critical for users utilizing the vertical jump system 100 in competition to keep the first member 114 and the second member 214 orthogonal, i.e. plumb in all directions. The levelling mechanism 150, 250 may therefore be built into the bottom portion 160, 260 of the outer housing base 148, 248. In the present configuration, the levelling mechanism 150, 250 may prevent disruption caused by loading forces transmitted by the flexible cord 122 or by users making physical contact with the flooring 132.

The slidable insert 152, 252 is connected to the bottom portion 160, 260 of the outer housing base 148, 248. The slidable insert 152, 252 slides along the bottom portion 160, 260 of the outer housing base 148, 248, and extends from the outer housing base 148, 248 along a second radial direction R2. The slidable insert 152, 252 is configured to slide under the flooring 132 such that the flooring 132 sits on top of the slidable insert 152, 252. The slidable insert 152, 252 must therefore be long enough to slide under the flooring 132 such that the flooring 132 holds the member base 144, 244 in place. Thus, the weight of the flooring 132 further stabilizes the member base 144, 244.

In traditional vertical jump systems, if lateral force is transferred to the vertical standard by the user dislodging the bar and trapping the bar against the bar support assembly, the vertical standard may fall over as the bar is dislodged. In the present configuration, however, the first member 114 and the second member 214 cannot be knocked over due to the weight of the flooring 132 stabilizing the member base 144, 244 of the first member 114 and the second member 214, respectively. As a result, the vertical jump system 100 remains upright if a user inadvertently contacts any component of the system 100.

Figure 5:
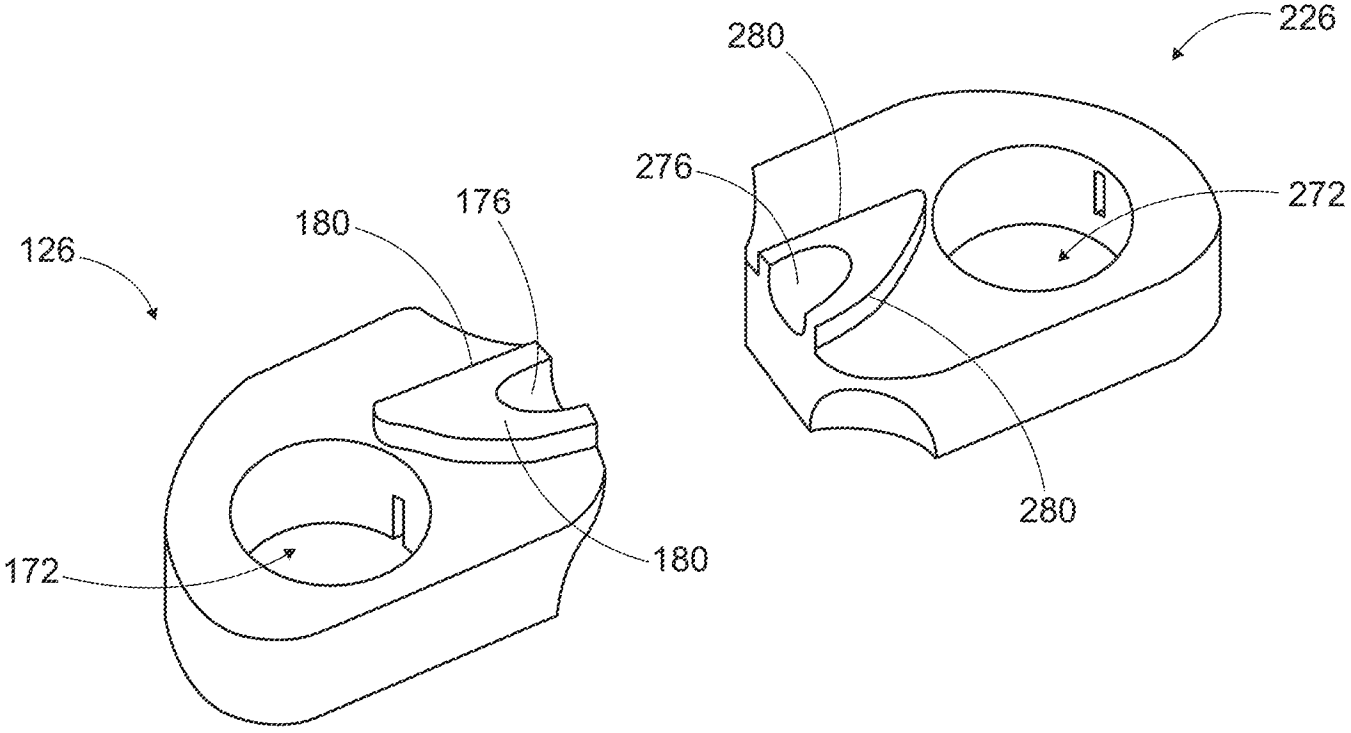
FIG. 5 is a perspective view of the first fixture and the second fixture shown in FIGS. 1-2B.
Figure 6A:
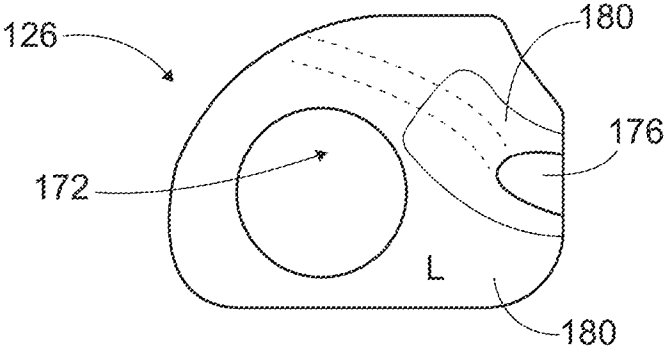
FIG. 6A is a plan view of the first fixture shown in FIG. 5.
Figure 6B:
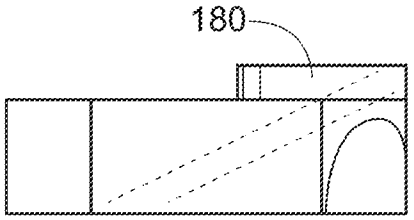
FIG. 6B is a front view of the first fixture shown in FIG. 5.
Figure 6C:
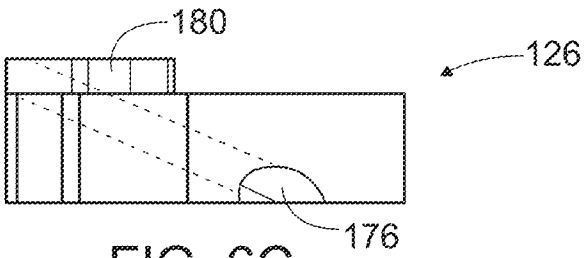
FIG. 6C is a back view of the first fixture shown in FIG. 5.
Figure 6D:
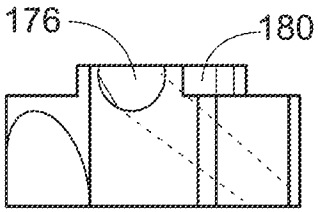
FIG. 6D is a side view of the first fixture shown in FIG. 5.
Figure 6E:
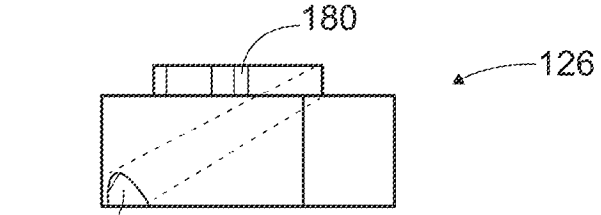
FIG. 6E is an opposite side view of the first fixture shown in FIG. 5.
Figure 7A:
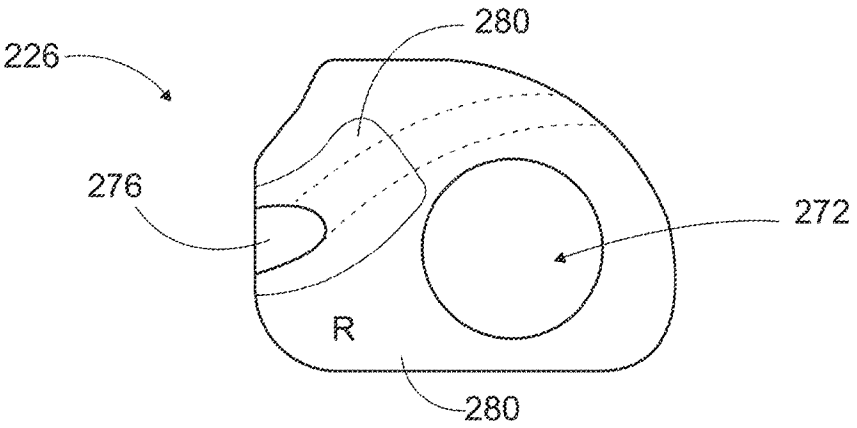
FIG. 7A is a plan view of the second fixture shown in FIG. 5.
Figure 7B:
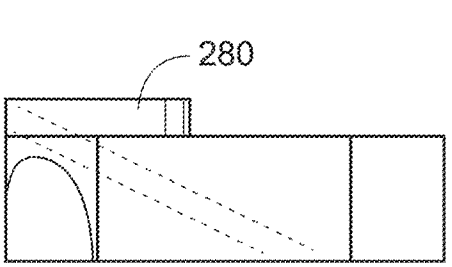
FIG. 7B is a front view of the second fixture shown in FIG. 5.
Figure 7C:
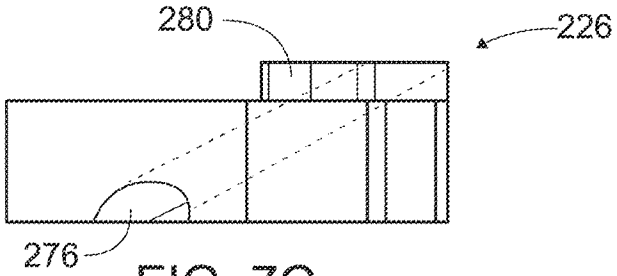
FIG. 7C is a back view of the second fixture shown in FIG. 5.
Figure 7D:
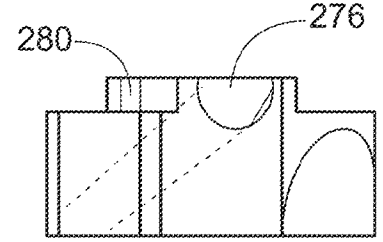
FIG. 7D is a side view of the second fixture shown in FIG. 5.
Figure 7E:
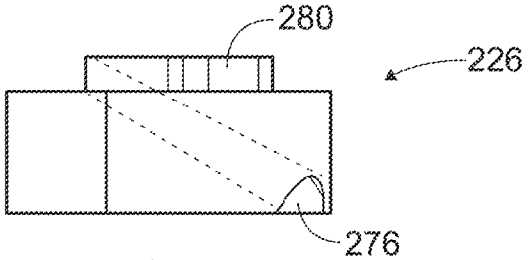
FIG. 7E is an opposite side view of the second fixture shown in FIG. 5.

Referring to FIGS. 5-6E, the first fixture 126 is positioned on the first member 114 and is configured to couple the first member 114 with the flexible cord 122. The first fixture 126 includes a hole 172 configured to allow the first member 114 to be inserted through the first fixture 126. The first fixture 126 is therefore sized and shaped to allow the first member 114 to pass through the first fixture 126. In the illustrated embodiment, the first fixture 126 is made of plastic. In other embodiments, the material comprising the first fixture 126 may vary.

In traditional vertical jump systems, the height of the crossbar is set using some sort of physical compression clamp. The compression clamp is most often utilized with a knob that is screwed tightly so that the adjustable bar support platform of the vertical standards cannot slide up and down. In the present configuration, however, the first fixture 126 is slidably adjustable along the first member 114 such that the flexible cord 122 can be adjusted to any desired height along the length of the first member 114.

The first fixture 126 further includes at least one passageway 176 spaced from the hole 172 and a plurality of diametrically opposed ridges or serrations 180 surrounding the passageway 176 and located in the interior of hole 172. The passageway 176 is sized and shaped to allow the flexible cord 122 to be inserted through the first fixture 126. The passageway 176 and the plurality of ridges 180 are configured to hold the flexible cord 122 in two-way tension at a desired height along the first member 114. The two-way tension allows the height of the flexible cord 122 to be adjusted through the passageway 176 and further through the plurality of ridges 180.

Referring to FIGS. 7A-7E, the second fixture 226 is positioned on the second member 214 and is configured to couple the second member 214 with the flexible cord 122. The second fixture 226 includes a hole 272 configured to allow the second member 214 to be inserted through the second fixture 226. The second fixture 226 is therefore sized and shaped to allow the second member 214 to pass through the second fixture 226. In the illustrated embodiment, the second fixture 226 is made of plastic. In other embodiments, the material comprising the second fixture 226 may vary. The second fixture 226 is also slidably adjustable along the second member 214 such that the flexible cord 122 can be adjusted to any desired height along the length of the second member 214.

The second fixture 226 further includes at least one passageway 276 spaced from the hole 272 and a plurality of diametrically opposed ridges or serrations 280 surrounding the passageway 276 and located in the interior of the hole 272. The passageway 276 is sized and shaped to allow the flexible cord 122 to be inserted through the second fixture 226. The passageway 276 and the plurality of ridges 280 are configured to hold the flexible cord 122 in two-way tension at a desired height along the second member 214. The two-way tension allows the height of the flexible cord 122 to be adjusted through the passageway 276 and further through the plurality of ridges 280.

Figure 8:
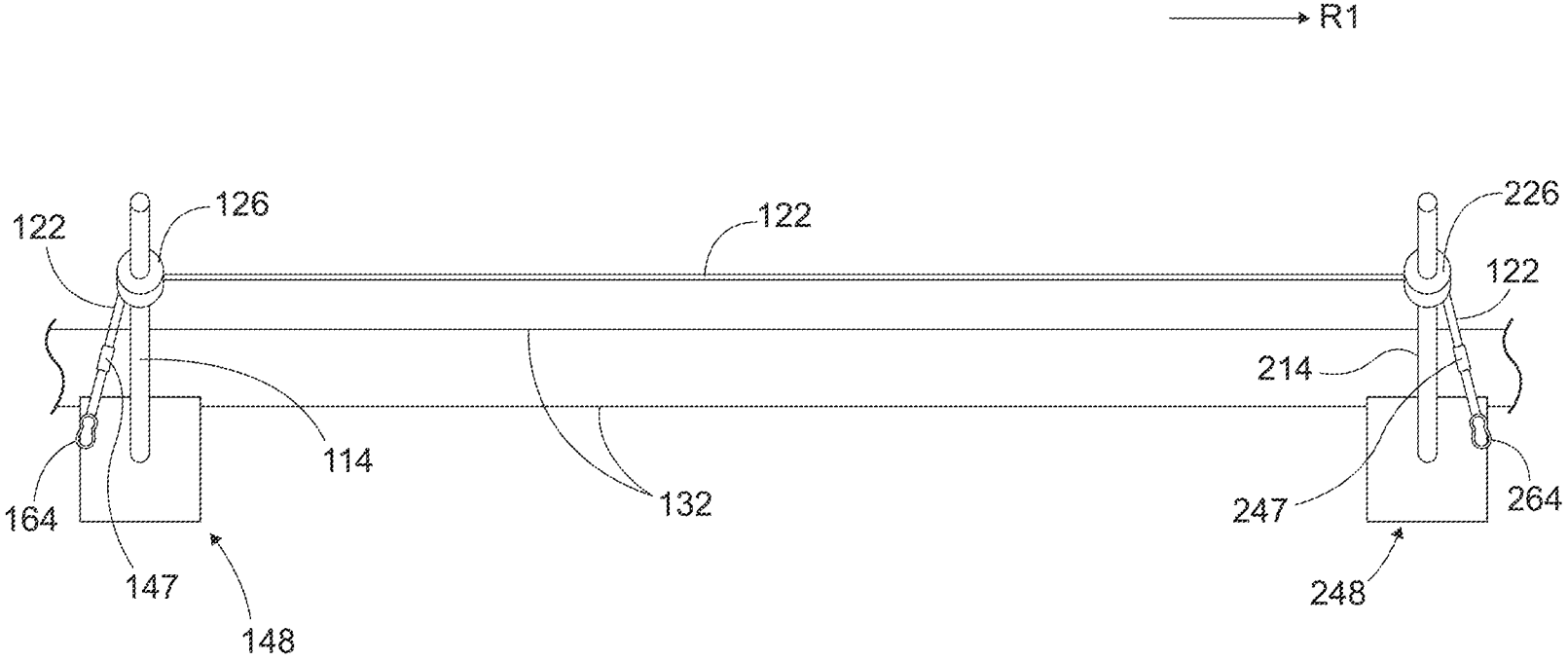
FIG. 8 is a detailed view of the flexible cord shown in FIG. 1.
Figure 9:
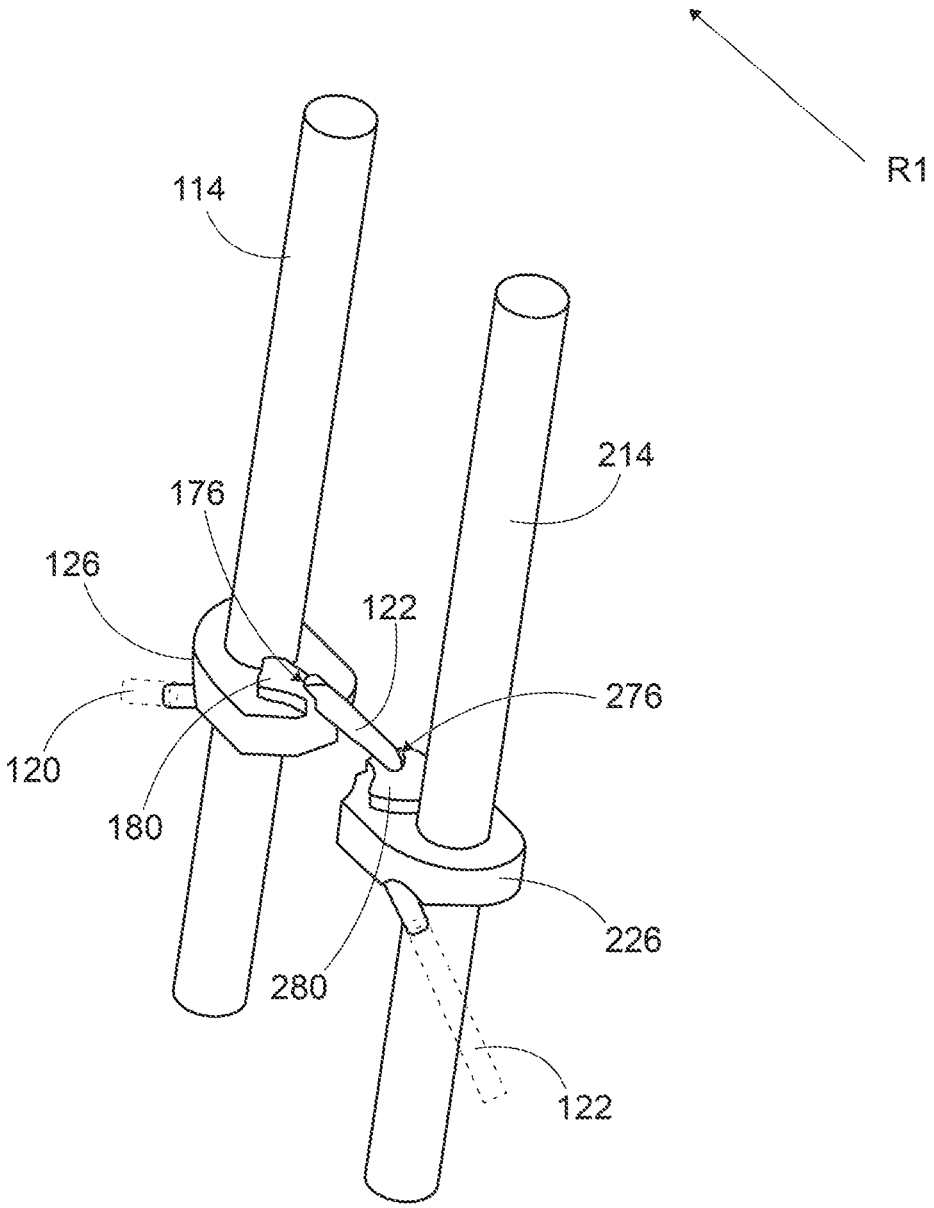
FIG. 9 is a diagram showing the flexible cord through the first fixture and the second fixture shown in FIG. 5.
Figure 10:
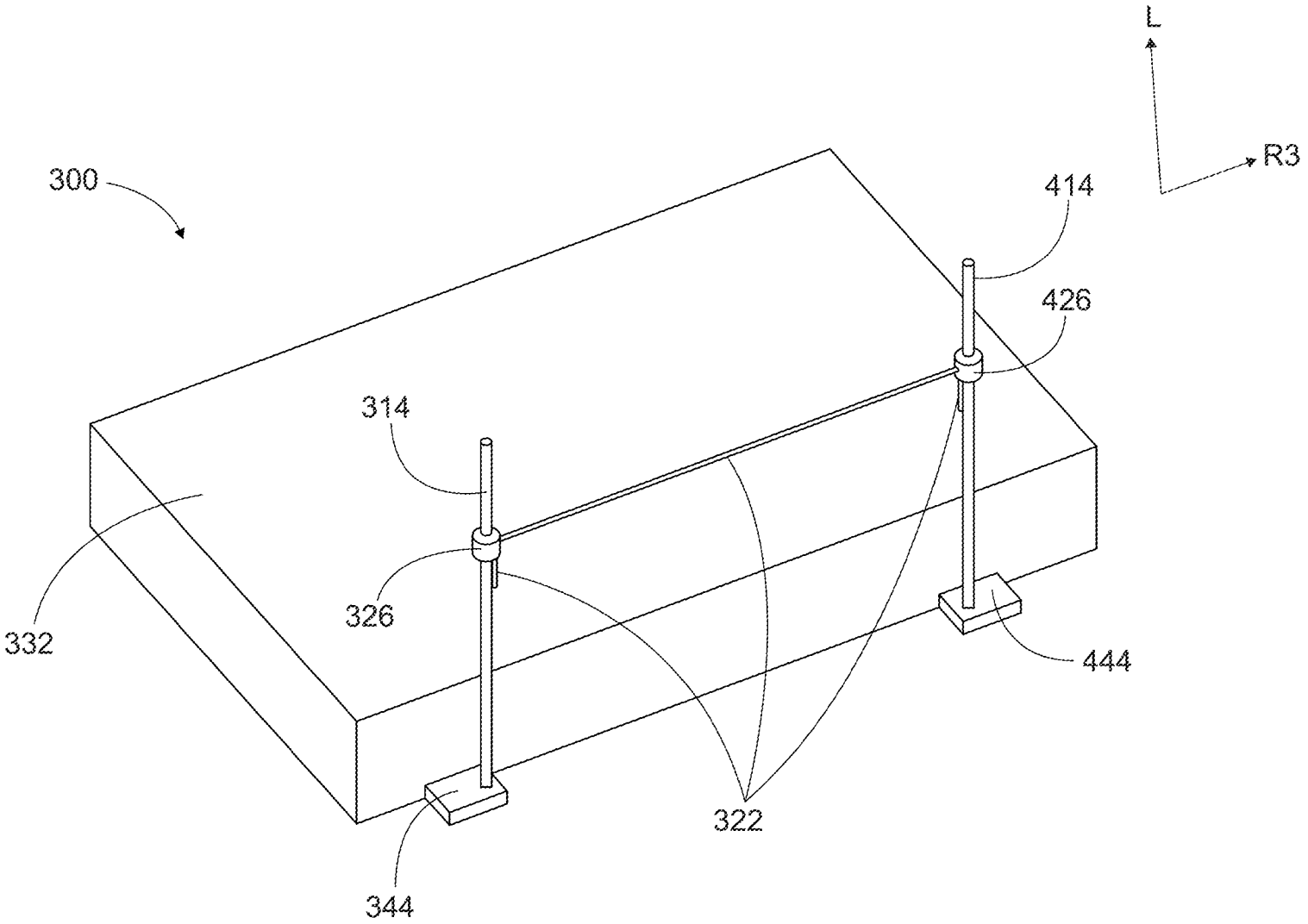
FIG. 10 is a perspective view of a vertical jump system, according to an embodiment of the present disclosure.
Figure 11:
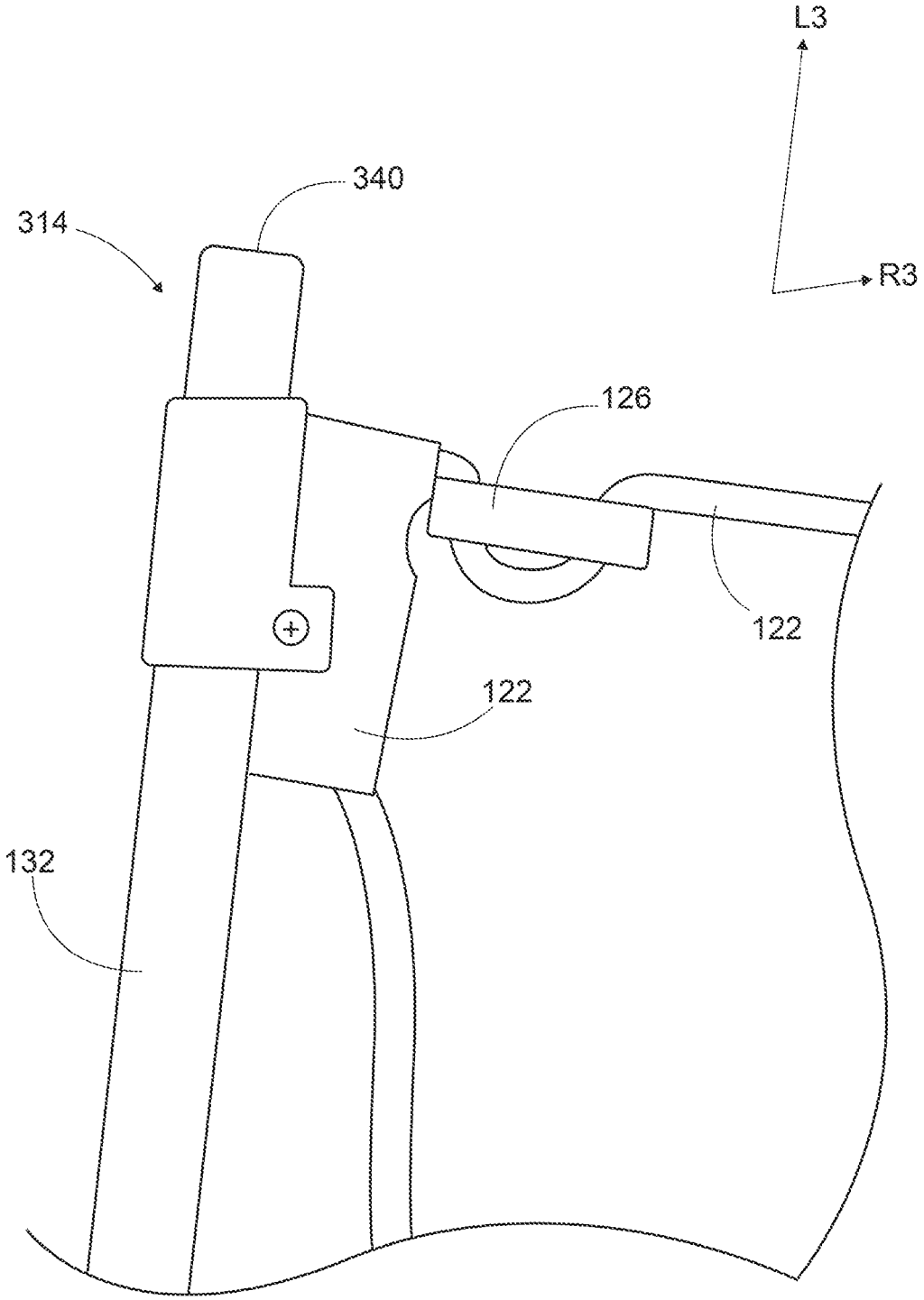
FIG. 11 is a detailed view of the first member shown in FIG. 10.

Referring to FIGS. 8 and 9, the flexible cord 122 extends along the first radial direction R1 between the first member 114 and the second member 214. The flexible cord 122 progresses through the first fixture 126, through the first support link 164 and then extends in a reverse direction through a first tension adjuster 147. In one embodiment, the flexible cord 122 couples to itself between the first tension adjuster 147 and the first fixture 126. In another embodiment, the flexible cord 122 may couple directly to the first member 114. Similarly, the flexible cord 122 progresses through the second fixture 226, through the second support link 264 and then extends in a reverse direction through a second tension adjuster 247. In one embodiment, the flexible cord 122 couples to itself between the second tension adjuster 247 and the second fixture 226. In another embodiment, the flexible cord 122 may couple directly to the second member 214. The ends of the flexible cord 122 may be attached to or encapsulated by clips to prevent fraying and unravelling of the cord ends.

In the illustrated embodiment, the support link 164, 264 is connected to the flexible cord 122 and the tension adjuster 147, 247 to couple the fixtures 126, 226 to the member base 144, 244. The tension adjuster 147, 247 may include a series of mechanisms utilizing springs, pulleys, friction devices, connecting equipment, gears, clamps, compression devices, releases, straps, clasps, tension devices, flexible cords, and self-winding reels to adjust the tension of the flexible cord 122 in order to keep the flexible cord 122 taut between the first fixture 126 and the second fixture 226.

The flexible cord 122 is coupled to the first member 114 via the first fixture 126 at a desired height. The flexible cord 122 is also coupled to the first member base 144 via the tension adjuster 147. Similarly, the flexible cord 122 is coupled to the second member 214 via the second fixture 226 at a desired height. The flexible cord 122 is also coupled to the second member base 244 via the tension adjuster 247. The height of the flexible cord 122 is adjustable along the first member 114 and the second member 214. In the illustrated embodiment, a user may adjust the height of the flexible cord 122 in a range from about three feet to about eight feet. In another embodiment, a user may adjust the height of the flexible cord to a height greater than eight feet. The flexible cord may comprise nylon, rubber, polypropylene, and polyurethane.

Traditional vertical jump systems utilizing cord crossbars secure the cord around the vertical standards that are independent of the crossbar structurally. Thus, the cord typically sags because it is passive in its operation. In the illustrated embodiment, however, the flexible cord 122 is configured to remain taut at the desired height as it is coupled to both the first fixture 126 on the first member 114 and the second fixture 226 on the second member 214.

Further, in traditional vertical jump systems, typical vertical standards that support a crossbar are independent structural units consisting of a vertical post attached to a bottom plate or pedestal. When a bar is placed on the bar support platforms in traditional systems, this action creates minimum downward pressure. As a result, when the user dislodges the bar, the bar falls off the assembly easily. In the illustrated embodiment, however, tension and friction of the flexible cord 122 through the first fixture 126 and the second fixture 226, as well as through the first tension adjuster 147 and the second tension adjuster 247, hold the flexible cord 122 at the desired height without slippage. The first fixture 126 and the second fixture 226 develop two-way tension which allows the adjustment of the flexible cord 122 through the at least one passageway 176, 276 and the plurality of ridges 180, 280. As a result, the flexible cord 122 surges one way when weight is applied and releases/recovers back the opposite way when the weight is removed.

Referring to FIGS. 10-12C, the present disclosure includes a vertical jump system 300. The vertical jump system 300 includes a first member 314, a second member 414 spaced from the first member 314, a first fixture 326 located on the first member 314, and a second fixture 426 located on the second member 414. The vertical jump system 300 further includes a flexible cord 322 coupled to slidable fixtures 326 along the first member 314 and the second member 414 and positioned at a desired height along the first member 314 and the second member 414 (FIG. 1). The flexible cord 322 acts as the "obstacle" for a user to jump over, and remains at a desired height when a user inadvertently contacts or actuates the flexible cord 322.

The vertical jump system 300 may be used for vertical jump training, athletics, and competition. The vertical jump system 300 may also be utilized indoors or outdoors, and in conjunction with various flooring 332. Thus, in one example, the flooring 332 may be a landing pit. In another example, the flooring 332 may be a landing pad. In yet another example, other types of flooring known in the art may be utilized. As a result, the vertical jump system 300 is not limited in use to a specific site or area, and may instead be used in numerous locations. The vertical jump system 300 may also be lightweight and portable. This configuration reduces the risk of injury to a user during training or competition, while also efficiently preventing the system from collapsing or dislodging.

Figure 12A:
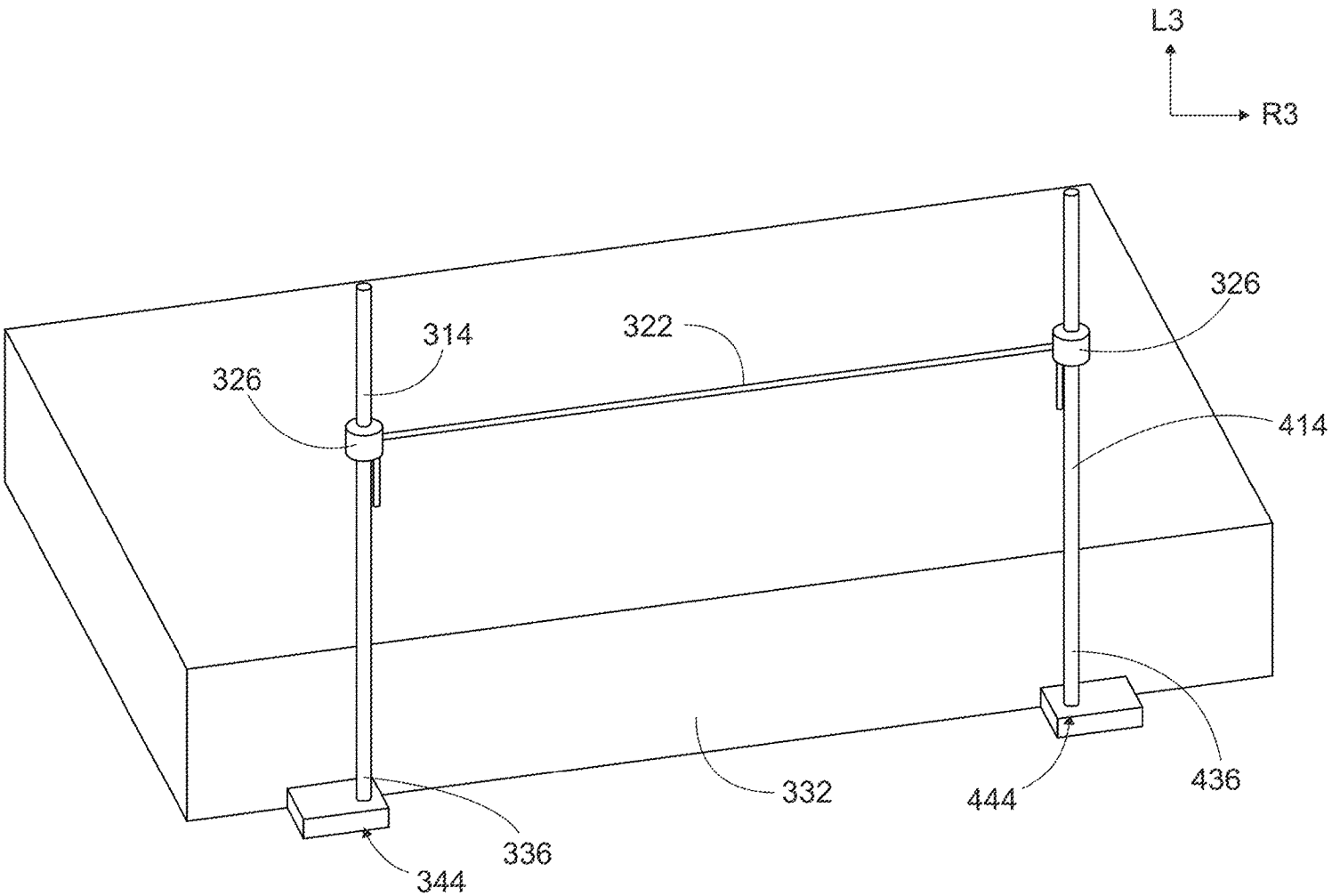
FIG. 12A is a detailed view of the first member base and the second member base shown in FIG. 10.
Figure 12B:
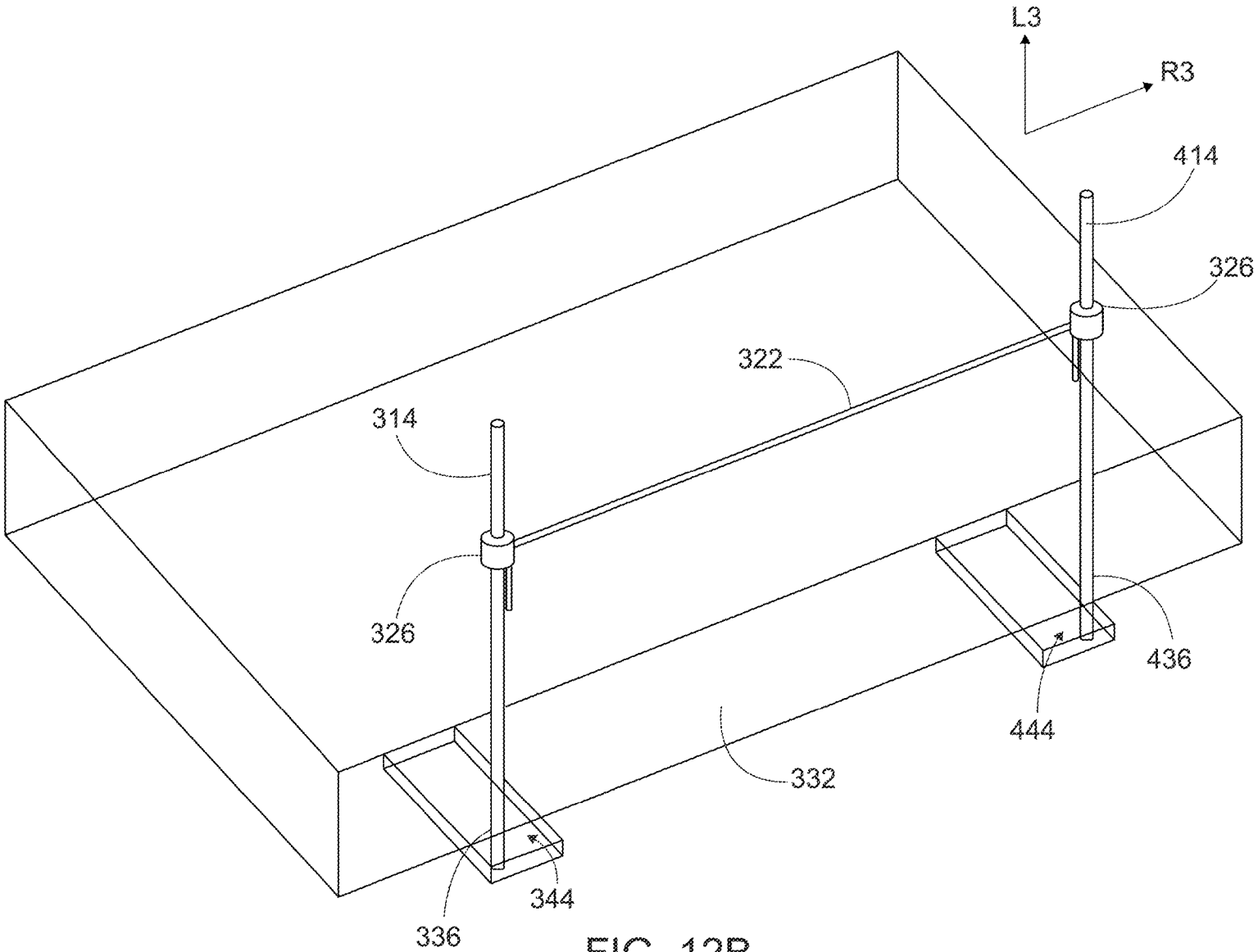
FIG. 12B is a detailed view of the first member base and the second member base shown in FIG. 10, according to an embodiment of the present disclosure.
Figure 12C:
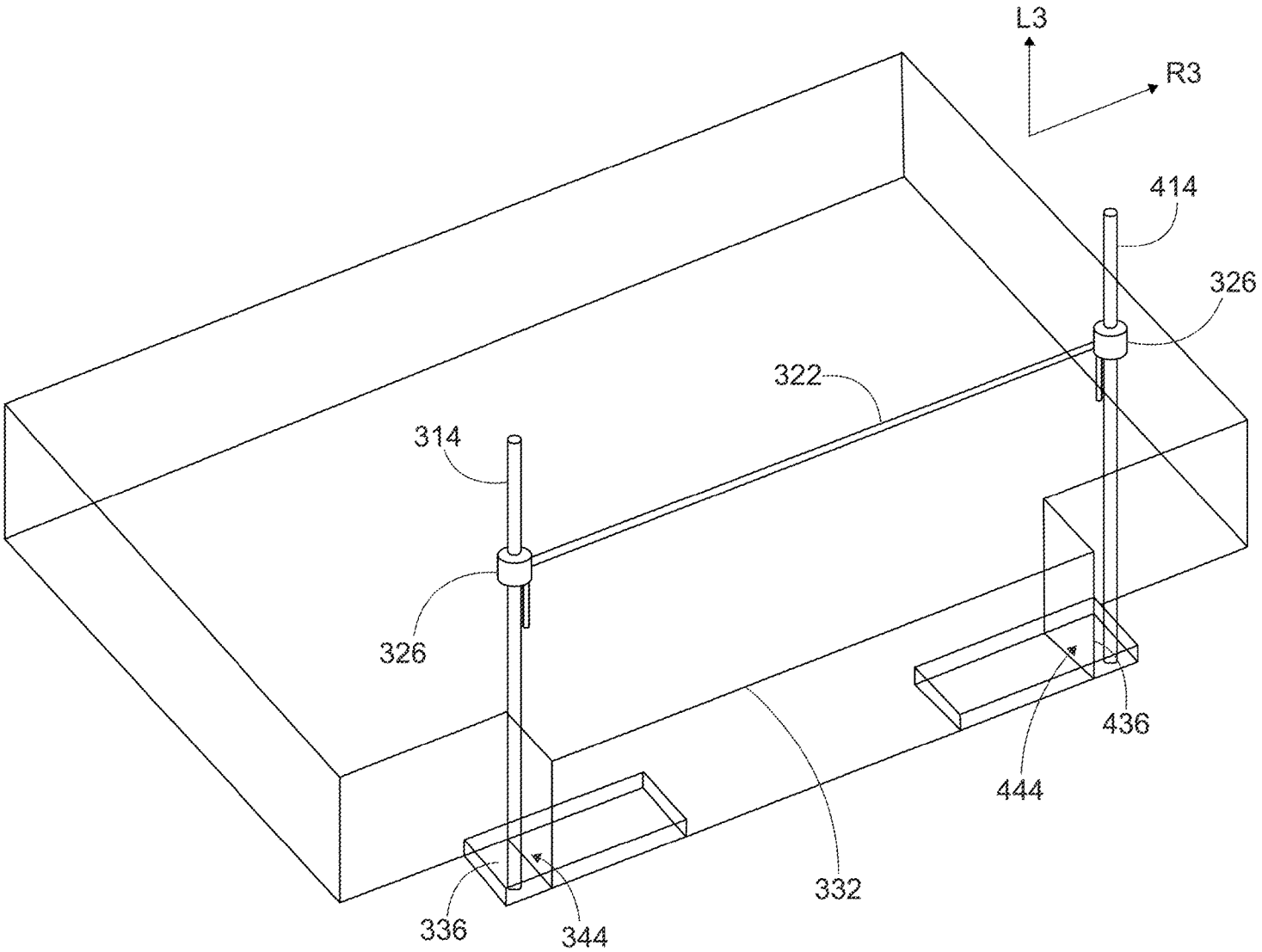
FIG. 12C is a is a detailed view of the first member base and the second member base shown in FIG. 10, according to an embodiment of the present disclosure.
Figure 13A:
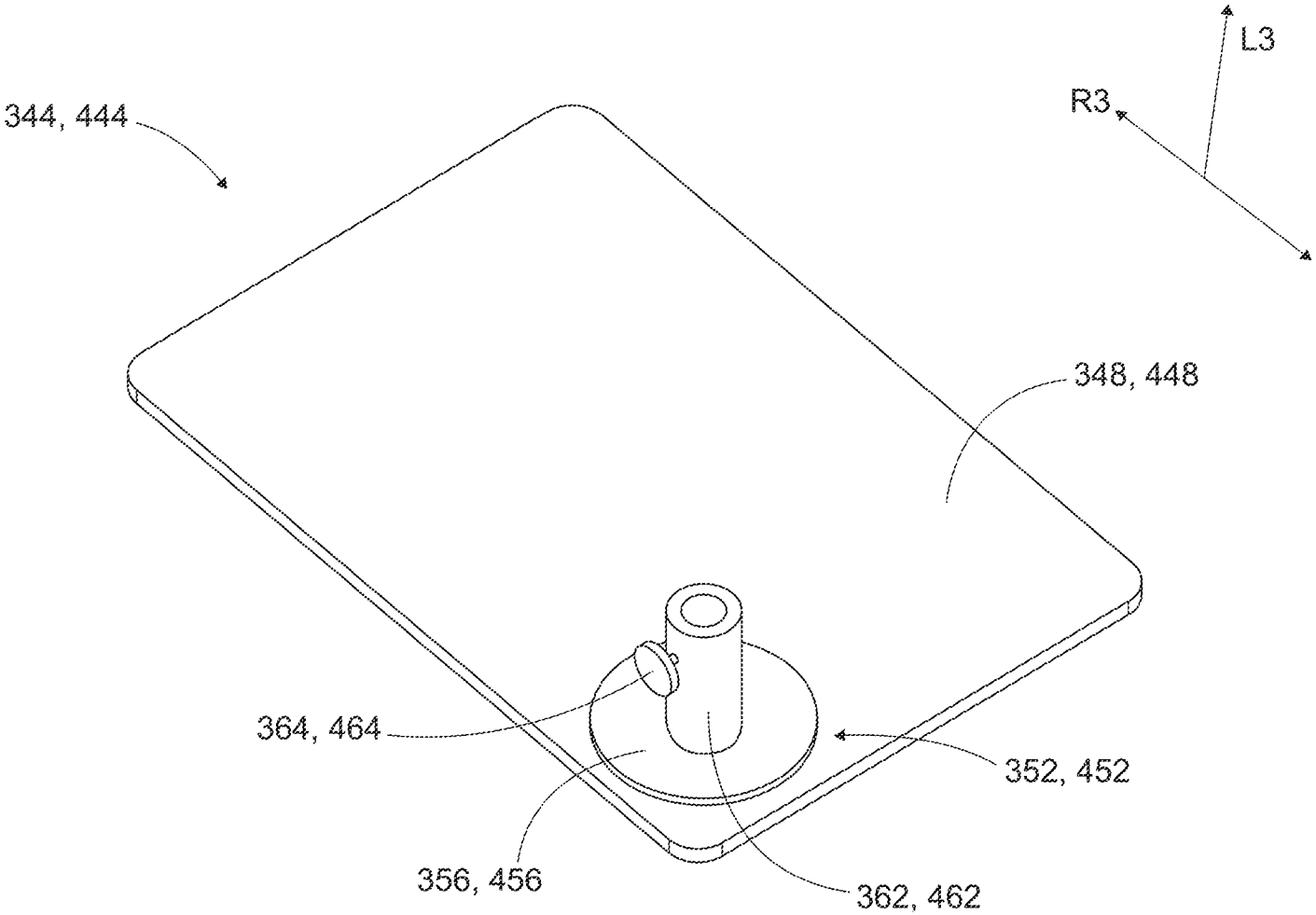
FIG. 13A is a perspective view of an exemplary member base shown in FIGS. 10-12.
Figure 13B:
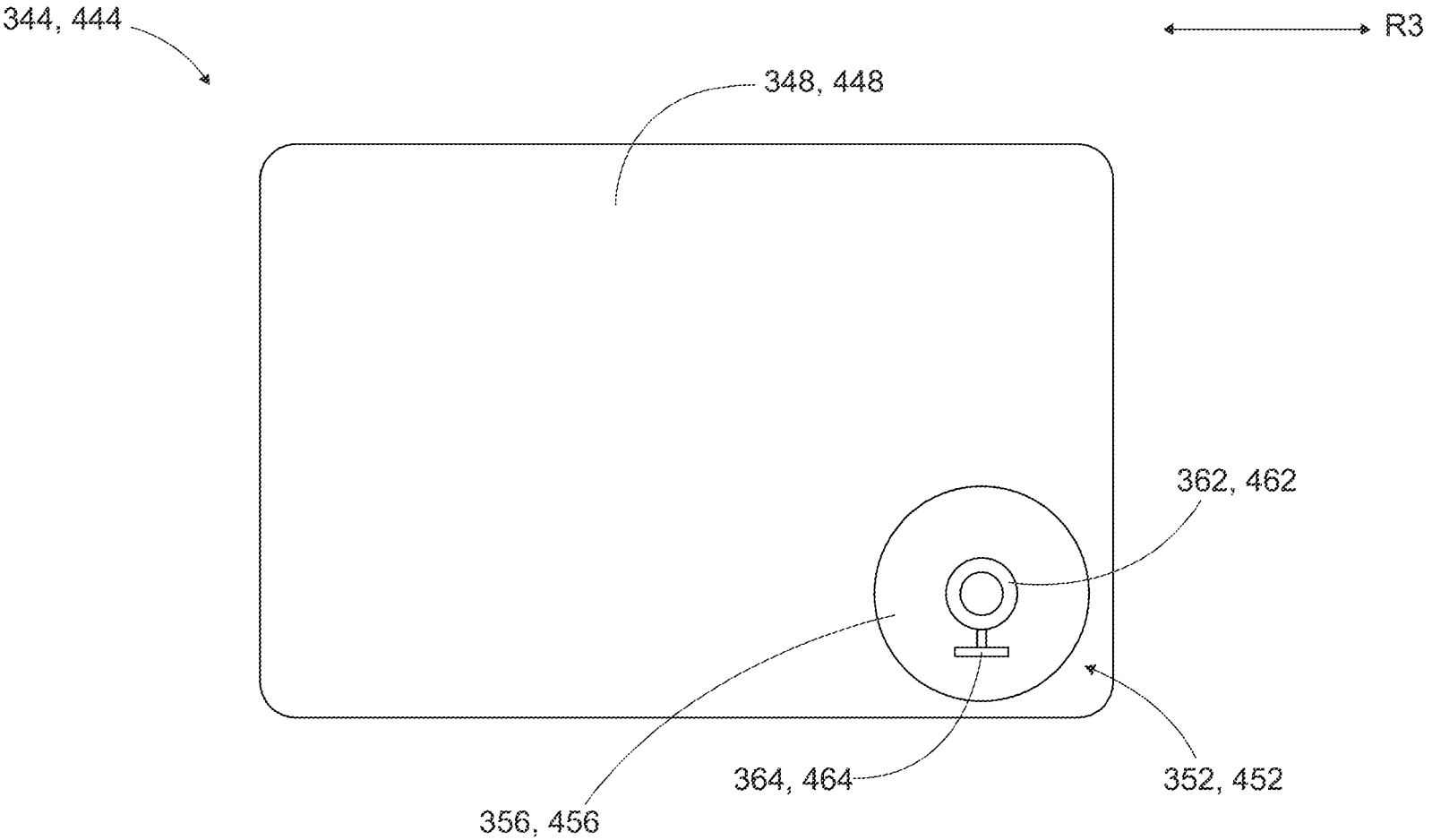
FIG. 13B is a drawing showing a plan view of the member base shown in FIG. 13A.
Figure 13C:
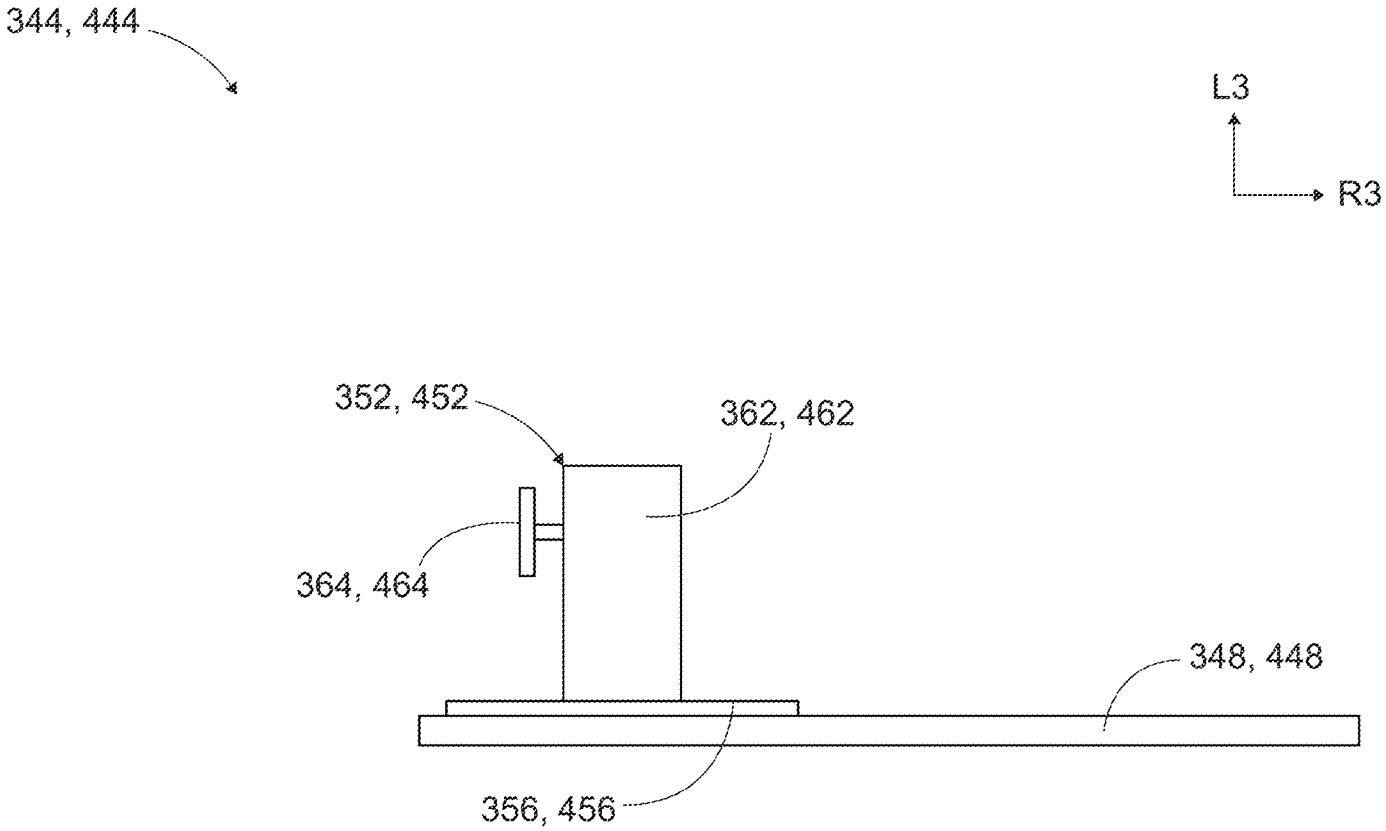
FIG. 13C is a drawing showing a front view of the member base shown in FIG. 13A.
Figure 13D:
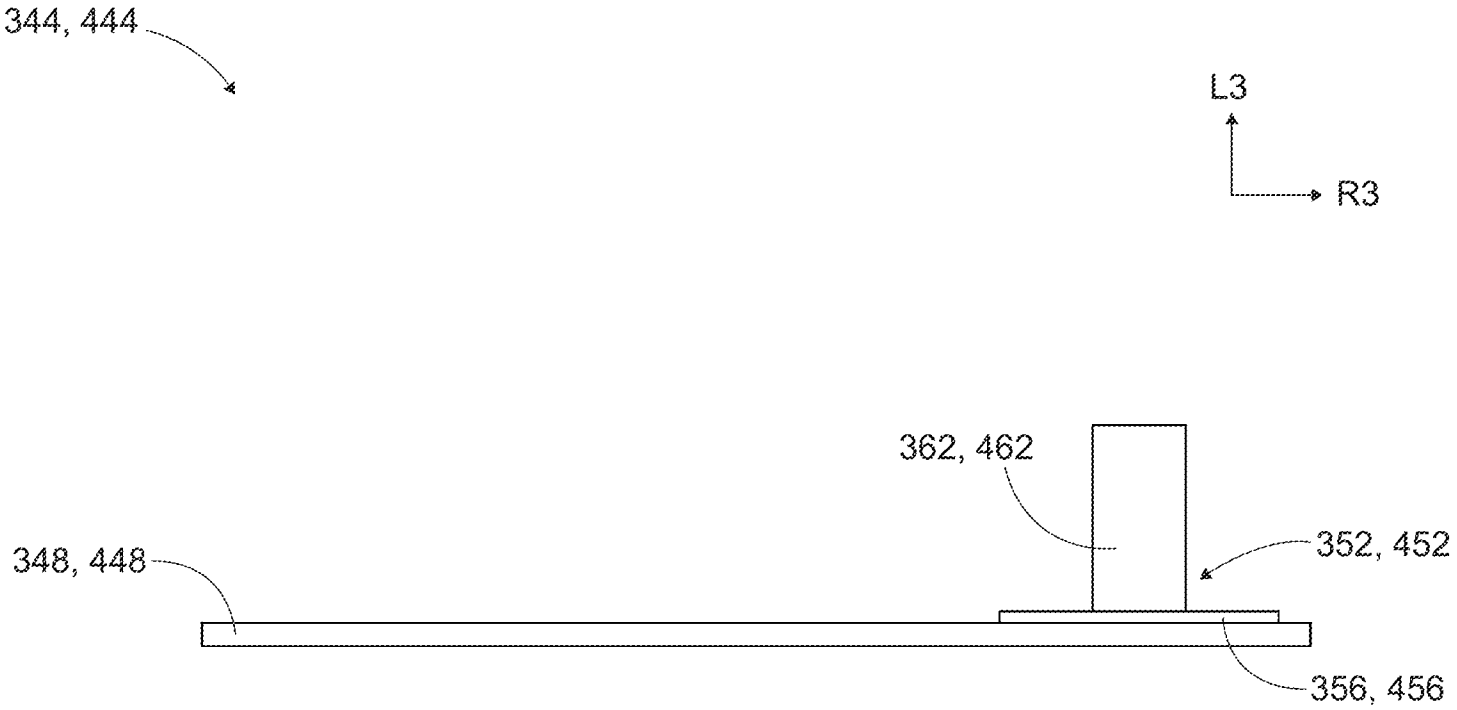
FIG. 13D is a drawing showing a side view of the member base shown in FIG. 13A.

Referring to FIGS. 10-12C, the first member 314 and the second member 414 are spaced from the first member 314 in a first radial direction R3. The first member 314 and the second member 414 include a distal end 336, 446 and a proximal end 340, 440 that extends from the distal end 336, 446 in a longitudinal direction L3. The distal end 336 of the first member 314 includes a member base 344 configured to couple the first member 314 to the flooring 332. The distal end 436 of the second member 414 further includes a member base 444 configured to couple the second member 414 to the flooring 332. The member base 344, 444 may be configured to partially slide under the flooring 332. In one embodiment, the member base 344, 444 may slide straight under the front edge of the flooring 332 (FIG. 12B). In another embodiment, the member base 344, 444 may slide on an inset from the front edge of the flooring (FIG. 12C).

In the illustrated embodiment, the first member 314 and the second member 414 are cylindrical in shape. In alternative embodiments, the shape of the first member 314 and the second member 414 may vary. The first member 314 and the second member 414 may be made of materials including, but not limited to galvanized steel or PVC pipe. In one embodiment, the first member 314 and the second member 414 may be made from commercially available material for wire shelf assemblies. In addition, in the illustrated embodiment, the length of the first member 314 and the second member 414 may range from about 3 feet to about 8 feet, and may be extendable. In another embodiment, the length of the first member 314 and the second member 414 may be greater than 8 feet.

The first member 314 and the second member 414 are configured to stabilize and couple the various components of the vertical jump system 300. Specifically, the first member 314 and the second member 414 stabilize the flexible cord 322 and allow the flexible cord 322 to be slidably adjusted along the first member 314 and the second member 414 via the first fixture 326 and the second fixture 426. The first member 314 and the second member 414 may display numbers in 1" increments from the distal end 336 to the proximal end 340. The first member 314 and the second member 414 may be epoxy-coated for UV and rust resistance.

In one embodiment, the first member 314 and the second member 414 may comprise two or more separate pieces that are connected to form the first member 314 and the second member 414 as single units. The connecting pieces may be dowel-like connections. In alternative embodiments, the pieces may utilize other known connection forms. The connections shall be tight enough such that the first member 314 and the second member 414 each may be lifted as single units without dismembering. The pieces may utilize an internal connection with no mid-point protrusion proud of the member to allow the fixtures 326 to slidably move up and down the first member 314 and the second member 414 without interference.

Referring to FIGS. 13A-13D, each of the first member 314 and the second member 414 include a member base 344, 444. The first member 314 includes a first member base 344. The first member base 344 is configured to slidably couple the first member 314 to the flooring 332.

The second member 414 includes a second member base 444. The second member base 444 is configured to slidably couple the second member 414 to the flooring 332. It should be noted that the structure and components of the first member base 344 and the second member base 444 are interchangeable. FIGS. 13A-13D are therefore used to describe both the first member base 344 and the second member base 444.

As shown in FIGS. 13A-13D, the member base 344, 444 includes a plate 348, 448 and a supporting member 352, 452. In one embodiment, the plate 348, 448 may be made of wood. In another embodiment, the plate 348, 448 may be made of metal or plastic. The supporting member 352, 452 includes a support base 356, 456 and a vessel 362, 462. The vessel 362, 462 is configured to receive the first member 314 and the second member 414. The vessel 362, 462 extends in the longitudinal direction L from the plate 348, 448. The vessel 362, 262 is sized and shaped to fit the distal end 336, 436 of the first member 314, and the second member 414, respectively. In the illustrated embodiment, the vessel 362, 462 includes a fastener 363, 463 that engages and holds the first member 314 and the second member 414 in place. In another embodiment, the first member 314 and the second member 414 may be held in the vessel 362, 462 by various known means. This configuration may allow the vertical jump system 300 to be easily converted from a system used in vertical jump training to a system used in vertical jump competition.

It is critical for users utilizing the vertical jump system 300 in competition to keep the first member 314 and the second member 414 orthogonal, i.e. plumb in all directions. In the present configuration, the plate 348, 448 may prevent disruption caused by loading forces transmitted by the flexible cord 322, by the first member 314 or the second member 414, or by users making physical contact with the flooring 332. The plate 348, 448 is configured to slide under the flooring 332 such that the flooring 332 sits on top of the plate 348, 448. The plate 348, 448 must therefore be long enough to slide under the flooring 332 such that the flooring 332 holds the member base 344, 444 in place. Thus, the weight of the flooring 332 further stabilizes the member base 344, 444. In one embodiment, foot stands may be utilized to further stabilize the member base 344, 444 to the flooring 332. In another embodiment, clips and spacers may be further utilized to fill potential gaps between the distal end of the first member 314 and the second member 414 and the respective vessel 362, 462.

In traditional vertical jump systems, if lateral force is transferred to the vertical standard by the user dislodging the bar and trapping the bar against the bar support assembly, the vertical standard may fall over as the bar is dislodged. In the present configuration, however, the first member 314 and the second member 414 cannot be knocked over due to the weight of the flooring 332 stabilizing the member base 344, 444 of the first member 314 and the second member 414, respectively. As a result, the vertical jump system 300 remains upright if a user inadvertently contacts any component of the system 300.

Figure 14:
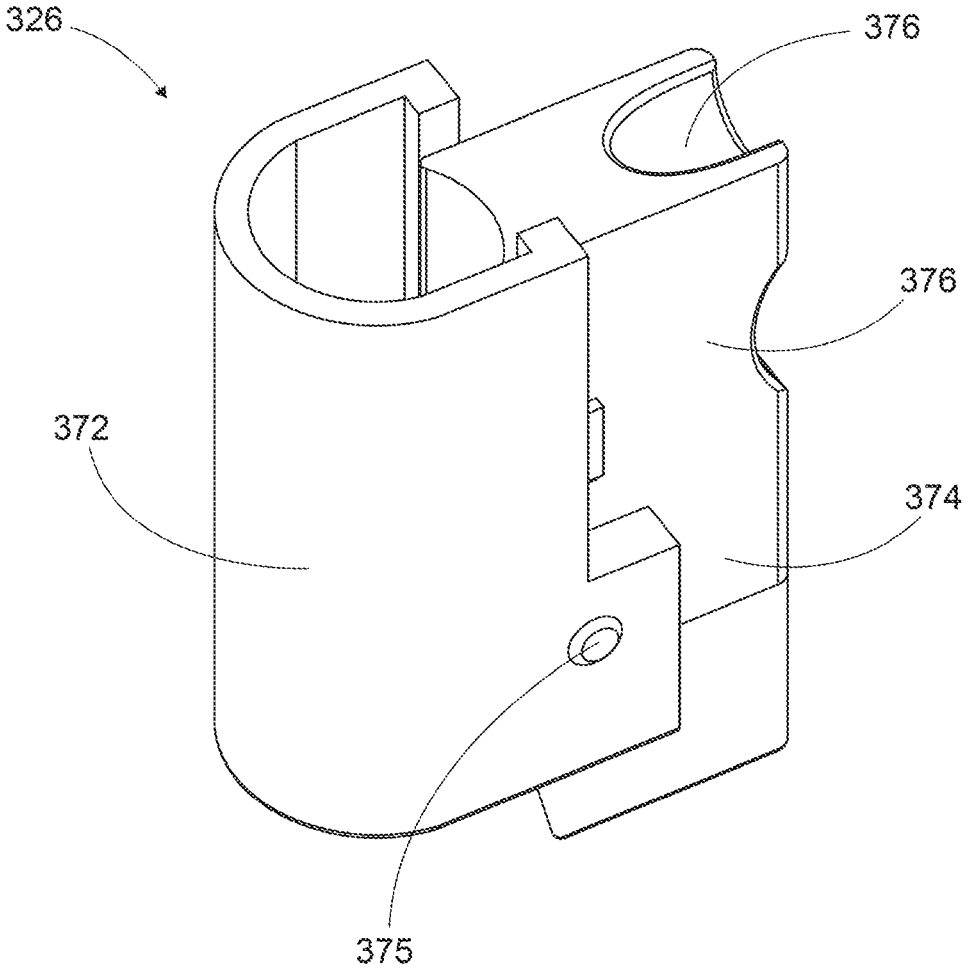
FIG. 14 is a perspective view of the fixture shown in FIGS. 10-12.
Figure 15A:
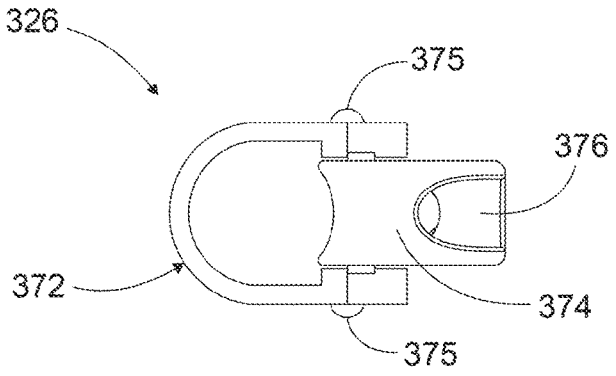
FIG. 15A is a plan view of the fixture shown in FIG. 14.
Figure 15B:
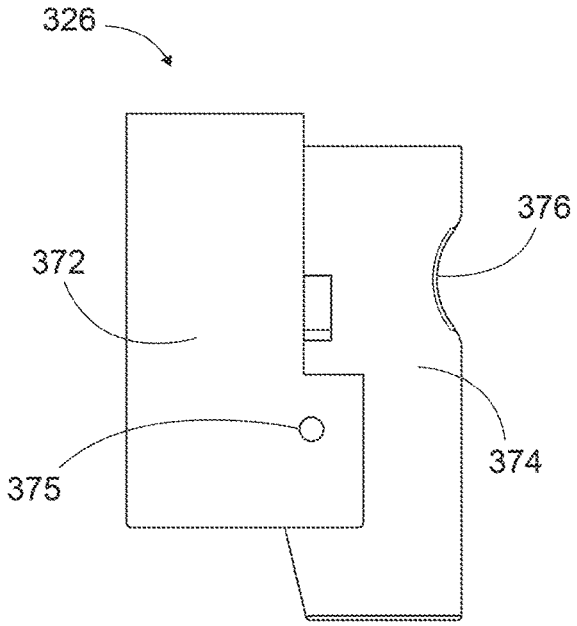
FIG. 15B is a front view of the fixture shown in FIG. 14.
Figure 15C:
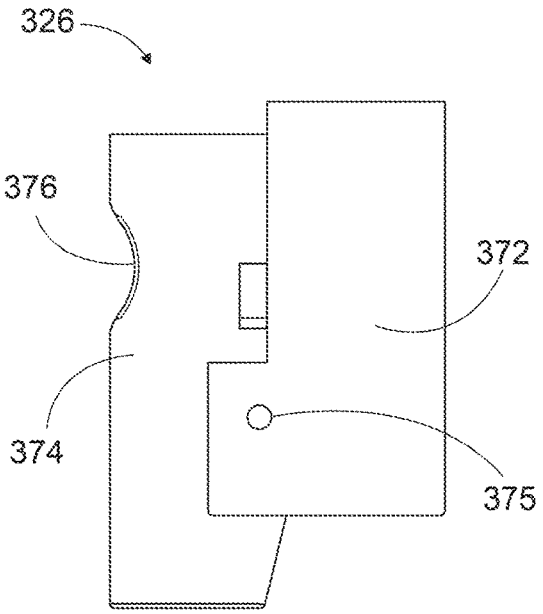
FIG. 15C is a back view of the fixture shown in FIG. 14.
Figure 15D:
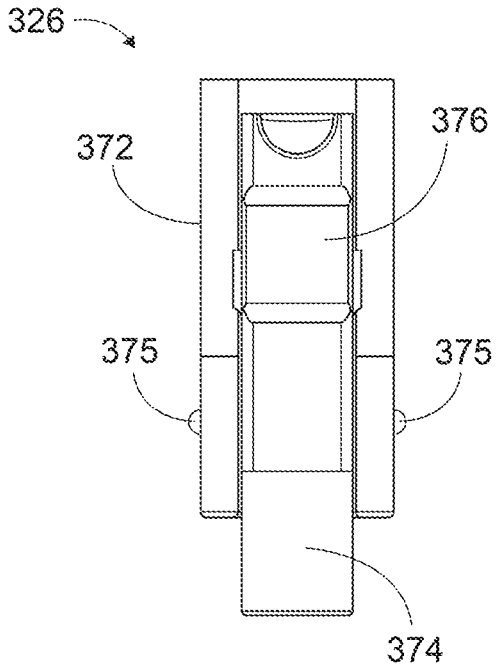
FIG. 15D is a side view of the fixture shown in FIG. 14.
Figure 15E:
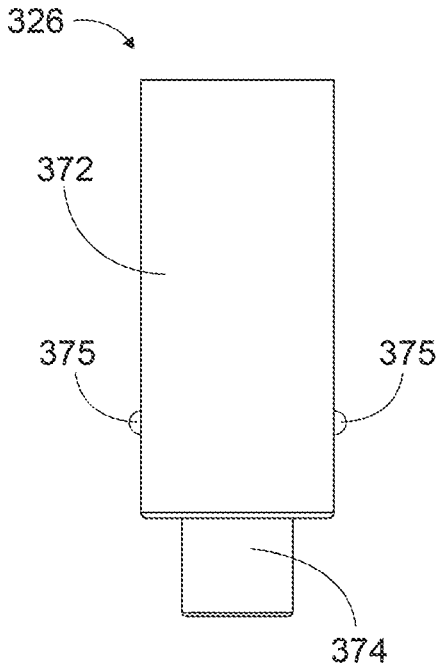
FIG. 15E is an opposite side view of the fixture shown in FIG. 14.

Referring to FIGS. 14-15E, the fixtures 326 are positioned on the first member 314 and the second member 414. The fixture 326 positioned on the first member 314 is configured to couple the first member 314 with the flexible cord 322. The fixture 326 positioned on the second member 414 is configured to couple the second member 414 with the flexible cord 322. In the illustrated embodiment, the fixtures 326 are made of plastic. In other embodiments, the material comprising the fixtures 326 may vary.

The fixtures 326 include a collar 372 configured to allow the first member 314 and the second member 314 to be inserted through the fixture 326. The collar 372 is therefore sized and shaped to allow the first member 314 or the second member 414 to pass through the fixture 326.

The fixtures 326 further include a block 374 coupled to the collar 372. The block 374 is configured to swivel away from the collar 372 along an axis A. The block 374 rotates around one or more screws 375 on the collar 372 which may act as a quasi-fulcrum. The block 374 includes at least one passageway 376. The passageway 376 is sized and shaped to allow the flexible cord 322 to be inserted through the fixtures 326.

The passageway 376 is configured to hold the flexible cord 322 in two-way tension at a desired height along the first member 314 and the second member 414. The flexible cord 322 is held at a preferred angle through the passageway 376 in order to provide friction pressure and prevent connection difficulties. The two-way tension allows the height of the flexible cord 322 to be adjusted through the passageway 376. In one embodiment, the passageway 376 may further include rigid members or cleats 377 to capture and secure the flexible cord 322. In alternative embodiments, the passageway 376 may pulleys, eye hooks, pedestal restraints and other known means to further secure the flexible cord 322.

When the block 374 is in a closed position, the block 374 rotates around the fulcrum 375 to press against the first member 314, the configuration provides pressure and friction through the flexible cord 322 which holds the first member 414, the second member 414, and the flexible cord 322 in place and bound to each other. When the block 374 is in an open position perpendicular to the member 314, 414, this configuration releases tension from the flexible cord 322 to allow effortless adjustment to the height of the fixture 326 along the first member 314 and second member 414.

In traditional vertical jump systems, the height of the crossbar is set using some sort of physical compression clamp. The compression clamp is most often utilized with a knob that is screwed tightly so that the adjustable bar support platform of the vertical standards cannot slide up and down. In the present configuration, however, the fixtures 326 are slidably adjustable along the first member 314 and the second member 414 such that the flexible cord 322 can be adjusted to any desired height along the length of the first member 314 and the second member 414.

Figure 16:
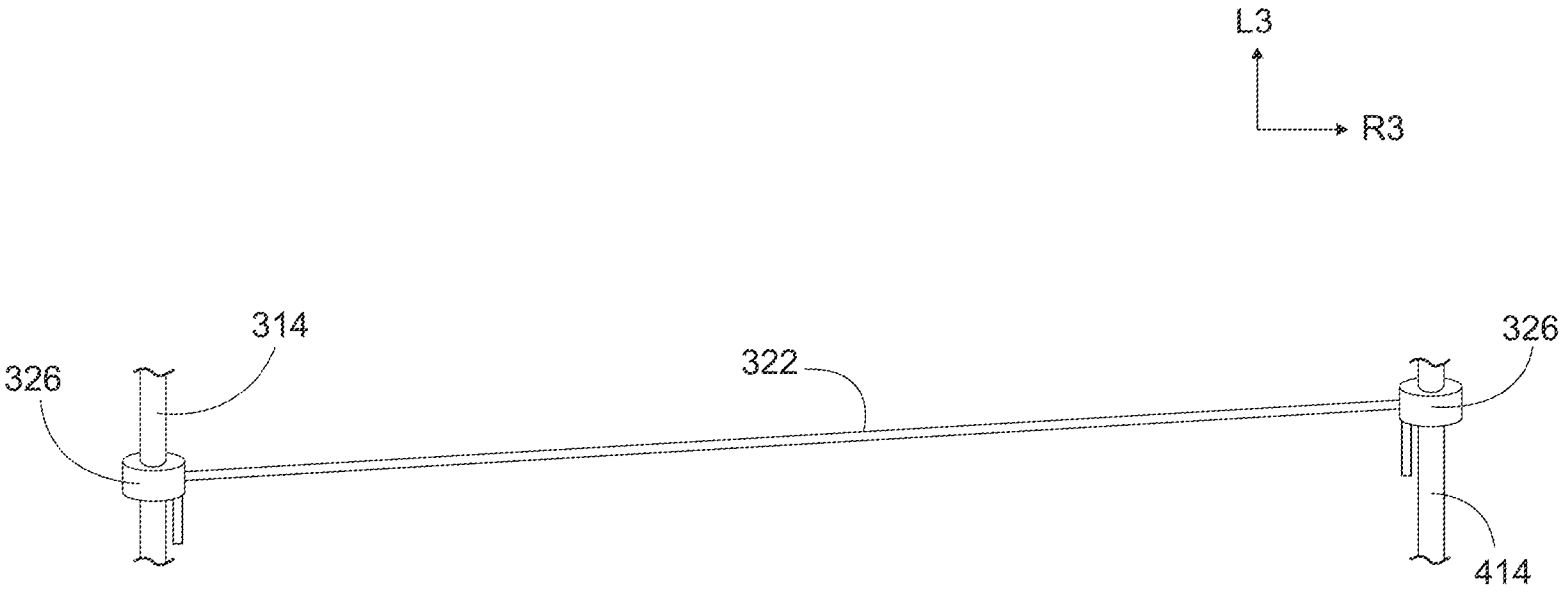
FIG. 16 is a detailed view of the flexible cord shown in FIG. 10.

Referring to FIGS. 16-18, the flexible cord 322 extends along the first radial direction R3 between the first member 314 and the second member 414 via the fixtures 326. The ends of the flexible cord 322 may be attached to or encapsulated by clips to prevent fraying and unravelling of the cord ends. The height of the flexible cord 322 is adjustable along the first member 314 and the second member 414. In the illustrated embodiment, a user may adjust the height of the flexible cord 322 in a range from about three feet to about eight feet. In another embodiment, a user may adjust the height of the flexible cord 322 to a height greater than eight feet. The flexible cord 322 may comprise nylon, rubber, polypropylene, and polyurethane.

Traditional vertical jump systems utilizing cord crossbars secure the cord around the vertical standards that are independent of the crossbar structurally. Thus, the cord typically sags because it is passive in its operation. In the illustrated embodiment, however, the flexible cord 322 is configured to remain taut at the desired height as it is coupled to the fixtures 326 on the first member 314 and the second member 414.

Further, in traditional vertical jump systems, typical vertical standards that support a crossbar are independent structural units consisting of a vertical post attached to a bottom plate or pedestal. When a bar is placed on the bar support platforms in traditional systems, this action creates minimum downward pressure. As a result, when the user dislodges the bar, the bar falls off the assembly easily. In the illustrated embodiment, however, tension and friction of the flexible cord 322 through the fixtures 326 hold the flexible cord 322 at the desired height without slippage. The fixtures 326 develop two-way tension which allows the adjustment of the flexible cord 322 through the passageway 376. As a result, the flexible cord 322 surges one way when weight is applied and releases/recovers back the opposite way when the weight is removed.

While the disclosure is described herein, using a limited number of embodiments, these specific embodiments are not intended to limit the scope of the disclosure as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in an order as desired.

The invention claimed is:

1. A vertical jump system comprising:

a first member that extends in a longitudinal direction from a flooring, the first member including a first member base configured to slidably couple the first member to the flooring;

a second member spaced from the first member that extends from the flooring in a longitudinal direction and parallel to the first member, the second member including a second member base configured to slidably couple the second member to the flooring;

a flexible cord that extends between the first member and the second member at a desired height, the flexible cord configured to remain at the desired height when contacted;

a first fixture positioned on the first member and configured to couple the first member with the flexible cord and slidably adjust the height of the flexible cord along the first member;

a second fixture positioned on the second member and configured to couple the second member with the flexible cord and slidably adjust the height of the flexible cord along the second member;

a collar configured to receive the first member, and a block coupled to the collar and having a passageway configured to receive the flexible cord therethrough, the block configured to move from a closed position that is parallel to the collar and holds the flexible cord taut to an open position that is perpendicular to the collar and releases the flexible cord.

2. The vertical jump system of claim 1, wherein the second fixture comprises:

a collar configured to receive the second member, and a block coupled to the collar and having a passageway configured to receive the flexible cord therethrough, the block configured to move from a closed position that is parallel to the collar and holds the flexible cord taut to an open position that is perpendicular to the collar and releases the flexible cord.

3. The vertical jump system of claim 1, wherein the flexible cord passes through the first fixture and the second fixture.

4. The vertical jump system of claim 1, wherein the first member base and the second member base is positioned under the flooring.

5. The vertical jump system of claim 1, wherein the flooring is interchangeable.

6. The vertical jump system of claim 1, wherein the flooring is a landing pit.

7. The vertical jump system of claim 1, further comprising connecting equipment configured to connect the first member base and the second member base to the flooring and to the first member and the second member.

8. The vertical jump system of claim 1, wherein the first member and the second member extend for a length of 8 feet.

9. The vertical jump system of claim 1, wherein the height of the flexible cord is adjustable along the first member and the second member each in a range from about 3 feet to about 8 feet.

10. The vertical jump system of claim 1, wherein the angle of the first fixture and the second fixture holds the flexible cord in two-way tension at the desired height along the first member and the second member.

11. A vertical jump system comprising:

a first member that extends in a longitudinal direction from a landing pad, the first member including a first member base configured to slidably couple the first member to the landing pad;

a second member spaced from the first member that extends from the landing pad in a longitudinal direction and parallel to the first member, the second member including a second member base configured to slidably couple the second member to the landing pad;

a flexible cord that extends between the first member and the second member at a desired height, the flexible cord configured to remain at the desired height when contacted;

a first fixture positioned on the first member and configured to hold the flexible cord in two-way tension at the desired height and slidably adjust the height of the flexible cord along the first member;

a second fixture positioned on the second member and configured to hold the flexible cord in two-way tension at the desired height and slidably adjust the height of the flexible cord along the second member;

a collar configured to receive the first member, and a block coupled to the collar and having a passageway configured to receive the flexible cord therethrough, the block configured to move from a closed position that is parallel to the collar and holds the flexible cord taut to an open position that is perpendicular to the collar and releases the flexible cord.

12. The vertical jump system of claim 11, wherein the second fixture comprises:

a collar configured to receive the second member, and a block coupled to the collar and having a passageway configured to receive the flexible cord therethrough, the block configured to move from a closed position that is parallel to the collar and holds the flexible cord taut to an open position that is perpendicular to the collar and releases the flexible cord.

13. The vertical jump system of claim 11, wherein the first member base and the second member base is positioned under the landing pad.

14. The vertical jump system of claim 11, wherein the landing is interchangeable.

15. The vertical jump system of claim 11, further comprising connecting equipment configured to connect the first member base and the second member base to the landing pad and to the first member and the second member.

16. The vertical jump system of claim 11, wherein the height of the flexible cord is adjustable along the first member and the second member in a range from about 3 feet to about 8 feet.

17. The vertical jump system of claim 11, wherein the first member and the second member extend for a length of 8 feet.

18. The vertical jump system of claim 11, wherein the angle of the first fixture and the second fixture holds the flexible cord in two-way tension at the desired height along the first member and the second member.

* * * * *